US007500568B2

(12) United States Patent
Cousin

(10) Patent No.: US 7,500,568 B2
(45) Date of Patent: Mar. 10, 2009

(54) STANDALONE DEVICE AND METHOD FOR MANAGING, DEPOSITING AND DISPENSING CASH

(75) Inventor: Patrick Cousin, Rueil Malmaison (FR)

(73) Assignee: Traidis, Rueil Malmaison (FR)

( * ) Notice: Subject to any disclaimer, the term of this patent is extended or adjusted under 35 U.S.C. 154(b) by 537 days.

(21) Appl. No.: 11/153,904

(22) Filed: Jun. 16, 2005

(65) Prior Publication Data

US 2006/0283685 A1 Dec. 21, 2006

(51) Int. Cl.
*B07C 5/00* (2006.01)

(52) U.S. Cl. ..... 209/534; 194/206; 194/207; 194/344

(58) Field of Classification Search ..... 194/206, 194/207, 215–217, 344; 453/1, 2; 209/534
See application file for complete search history.

(56) References Cited

U.S. PATENT DOCUMENTS 3,682,183 A * 8/1972 Morrow et al. ..... 221/79
4,510,381 A * 4/1985 Fukatsu ..... 194/350
6,318,537 B1 * 11/2001 Jones et al. ..... 194/346
6,607,124 B1 * 8/2003 Junkins et al. ..... 235/379
6,983,836 B2 * 1/2006 Adams et al. ..... 194/302
7,014,554 B1 * 3/2006 Fletcher et al. ..... 453/20
7,156,295 B2 * 1/2007 Ryan et al. ..... 235/379
7,213,697 B2 * 5/2007 Martin et al. ..... 194/317
7,216,591 B2 * 5/2007 Katou et al. ..... 104/206
2002/0152141 A1 * 10/2002 Carter ..... 705/29
2004/0231956 A1 * 11/2004 Adams et al. ..... 194/217
2004/0249501 A1 * 12/2004 Hand et al. ..... 700/231

* cited by examiner

*Primary Examiner*—Patrick H Mackey
*Assistant Examiner*—Terrell H Matthews
(74) *Attorney, Agent, or Firm*—Lowe Hauptman Ham & Berner LLP

(57) ABSTRACT

An automatic machine manages the development of the amount of stored cash and allows a user to deposit, sort or count coins or banknotes. The machine has a storer and dispenser for coins and notes. The machine includes a computer system and receivers and sorters of coins and notes. A front face of the machine has an interface, first components for depositing and withdrawing notes, and second components for depositing and withdrawing coins by a user. A rear face, opposite to the front face, includes an interface for unlocking a first access from the rear to the coin storer and/or a second access from the rear to the note storer.

22 Claims, 16 Drawing Sheets

STANDALONE DEVICE AND METHOD FOR MANAGING, DEPOSITING AND DISPENSING CASH

FIELD OF THE INVENTION

The object of the present invention is an automatic machine and a method for managing change, cash takings, or till cash, which may in particular be used for automating this management, in particular in the case of geographically scattered users each managing their own till.

BACKGROUND OF THE INVENTION

Devices are known in the field of automated management of coins, which use a coin sorter for counting coins, and hoppers for dispensing till cash, a composition pre-programmed in a microcontroller built into the automatic machine. Such devices are entirely or partly described by patents U.S. Pat. Nos. 5,830,054, 6,196,913, and FR 2 784 772. With these devices, productivity may be improved for certain tasks for managing coins, mainly in stores of a certain importance. However, with their capacities, it is not possible to automate the formation of till cash amounts comprising banknotes, and moreover they have a geometry suitable for only one type of cash drawer. Moreover, the limits of their programming possibilities do not always allow them to perform sufficiently different tasks in order to authorize a sufficiently comprehensive use or according to a sufficiently autonomous operation.

Patent application FR 0105624 teaches a till cash dispenser which may be more flexibly managed and programmed by a standard type of computer, for dispensing determined amounts of coins of different types as well as of two types of banknotes. Because of its flexibility, and the dispensing of banknotes, with such an automatic machine, productivity of the services of a central cash desk may be increased in a medium or large retail store, but it always requires that it be filled regularly and it only provides a limited number of operations.

For managing the takings and the till cash amounts of small units, such as small retail shops or services in which each intervening person manages her/his own till autonomously, such as public transport conductors or bartenders or catering waiters, it may however be helpful to automate more numerous and varied tasks without however occupying personnel for this purpose.

For example, it may be helpful to allow such an intervening person to get rid of his/her takings and to have them counted and recorded regularly, in particular for limiting losses in the case of theft. It may also be helpful to allow such an intervening person to get or purchase change at any moment. In particular, such tasks are difficult to automate when the different intervening persons are not grouped together in a same location, and/or move around in not very-secure or badly secured locations.

An automatic machine for managing coins or takings or till cash, as coins and notes, which may be fed or emptied by interventions which do not interfere with the management of the cash contained in the device, is known from patent application EP 1 376 488.

However, such an automatic machine does not guarantee security for the operators responsible for performing global withdrawal of the takings or filling it with coins and notes or other operations for managing the automatic machine.

SUMMARY OF THE INVENTION

An object of the invention is therefore to propose an automatic machine and a method for managing change, takings, or till cash, the management or programming of which is sufficiently flexible, and the capacities are sufficiently large to allow autonomous operation for the user, while facilitating and securing the management and interventions of the specialized operators.

An object of the invention is also to propose an automatic machine and a method for managing change, takings, or till cash, requiring that the latter be followed up, emptied or fed less frequently.

These objects are achieved by an automatic machine for managing change or takings or till cash, as coins and notes, allowing a user to perform one or more operations comprising the deposit, sorting, or counting of coins or banknotes, this automatic machine comprising means for storing coins, means for storing notes, as well as means for dispensing coins and means for dispensing notes capable of distributing a determined composition of different types or values of coins or notes, said automatic machine being coupled to a computer system and comprising means for receiving and sorting coins and means for receiving and sorting banknotes in order to provide functions for respectively receiving, recognizing and sorting coins, notes, said automatic machine being characterized in that it consists of a device having:

a front face including an interface, first components for depositing and withdrawing notes, and second components for depositing and withdrawing coins by a user; and a rear face opposite to the front face, including an interface provided for unlocking at least one first access from the rear to the means for storing coins and/or at least one second access from the rear to the means for storing notes.

According to one feature, the interface for unlocking may exclusively be actuated after introducing an identification code of an operator and checking this code with a list of codes stored by the computer system.

According to one feature, the computer system comprises parameterization means arranged for parameterizing, via the interface of the front face, the dispensing of coins and the dispensing of notes, the interface being provided in order to take into account an identification of a user, said parameterization means including:

means for controlling the coin dispensing means, laid out for triggering the ejecting units respectively positioned at an outlet of a coin storage location in order to initiate displacement of a determined number of coins towards the coin dispensing means; and means for controlling the note dispensing means, laid out for triggering means for picking up notes in order to initiate displacement of a determined number of notes towards the note dispensing means;

said computer system also including:

means for calculating an amount corresponding to the received coins or notes, recognized by the receiving and sorting means, and storage means for storing data representing said amount and associating said data with data identifying a user.

According to one feature, the automatic machine comprises means for storing information representing the coins and notes received by the receiving means or dispensed by the dispensing means during an operation, this information being stored in association with an identification of a user of the automatic machine for this operation.

According to one feature, the dispensing means are controlled by control means driven by the computer system in order to dispense, for each type or value of coin or note, a determined amount stored or calculated by the computer system depending on a requested operation type, an identification of the user of the automatic machine, or depending on an amount or value of coins or notes, received by the receiving and sorting means, or a combination of these items.

According to one feature, the means for storing coins comprise a plurality of hopers having means for ejecting single coins and means for counting the ejected coins, and each supplied with a same type or same value of coins, whereby these coins may be automatically supplied to them from the coin receiving and sorting means.

According to one feature, the ejected coins of the hoppers are forwarded by a plurality of chutes, the outlets of which are positioned according to a specific geometry allowing the dispensed coins to be distributed into different compartments of a container or cash drawer with a determined shape, at least one of these compartments receiving coins of same value or type.

According to one feature, at least two chutes are combined into a dispensing block determining a geometry for distributing the coins, suitable for a type of container or cash drawer, this dispensing block being positioned at the outlet of the hoppers by positioning means allowing the use of several different interchangeable blocks suitable for different types of containers.

According to one feature, the automatic machine comprises at least two interchangeable dispensing blocks, the changing of which is achieved by actuation means controlled by the computer system or the user.

According to one feature, the means for storing banknotes comprise at least two cassettes and/or storage rolls provided with dispensing and counting means, each of these cassettes containing notes of a same type or a same value, as well as at least one cassette and/or roll which receives notes of several different types, at least one of these cassettes and/or rolls being able to automatically receive notes from the means for receiving and sorting notes.

According to one feature, the automatic machine comprises means for communicating with a computerized portable object including storage means, and for storing at least one datum for identifying a user of the automatic machine.

According to one feature, the storage means are locked up in a closed device, a so-called dispenser, so as to make the stored coins and notes inaccessible to the user, this dispenser comprising means for externally transferring coins or notes, these transfer means comprising at least one container feeding the storage means of the dispenser, or receiving coins or notes coming from the inside of the dispenser, these transfer means being able to either feed the dispenser or be fed by the dispenser and being able to be transported out of the dispenser by a transfer operator, without having said operator access the coins or notes contained in the dispenser or in the transfer means.

According to one feature, the computer system comprises an internal computer located inside the dispenser and storing parameters allowing autonomous operation of the automatic machine for a plurality of operations.

According to one feature, the internal computer is able to communicate with a keyboard external to the dispenser and forming input means for this computer, via a temporary electrical connection or wireless communication means, without requiring that the dispenser be opened.

According to one feature, the computer is able to communicate with at least one computer system external to the automatic machine, via a computer network or a permanent or temporary computer link, this communication allowing the remote reporting or parameterization of the available operations or data bases used during these operations.

According to one feature, the means for receiving the coins are located in the upper portion of the dispenser, the coins passing from the receiving and sorting means to the storing means under the effect of gravity, the dispenser comprising a receptacle located at a determined height lower than that of the receiving and sorting means, this receptacle being able to receive coins to be sorted, deposited by the user at a substantially lower height than that of the receiving and sorting means, and to be then displaced by the raising means up to said receiving means in order to pour the coins which it contains, into them According to one feature, the computer system comprises a computer using an operating system running according to an interactive graphic interface in order to apply the management or parameterization of the available operations or of the data bases used during these operations.

According to one feature, the raising means comprise a coin lifting unit interposed between a first coin forwarding unit connected to a front port the automatic machine on the one hand, and on the other hand a coin forwarding unit connected to a rear port of the automatic machine.

According to one feature, said first access from the rear comprises an access hatch communicating with the second forwarding means.

According to one feature, said second access from the rear comprises a door for accessing a safe for storing notes, said safe being equipped with translationally mobile note cassettes on slides to allow said cassettes to be removed towards the rear.

According to one feature, the cassettes include at least one code provided in order to be read by reading means which may thereby identify each cassette and the amount of the contents corresponding to the identified cassette.

According to one feature, the interface of the rear face is provided for associating at least one code with each of the cassettes, said code being read by reading means of the interface of the rear face in order to identify each cassette and the amount of contents corresponding to the identified cassette.

According to one feature, the interface provided on the rear face includes a display screen and input means for notifying a coin provision or withdrawal operation of the one hand, and on the other hand a note provision or withdrawal operation, the screen and the input means being connected to the computer system which uses said storage means for storing data representing an amount from the notified operations and the identity of the operator.

According to one feature, the automatic machine is provided with means for checking withdrawn or provided amounts by counting coins and notes, said checking means being connected to the interface of the front face and to the interface of the rear face in order to perform a check of a first total amount corresponding to the coins present in the automatic machine, and of a second total amount corresponding to the notes present in the automatic machine.

The above and still further objects, features and advantages of the present invention will become apparent upon consideration of the following detailed description of specific embodiments thereof, especially when taken in conjunction with the accompanying drawings.

DETAILED DESCRIPTION OF THE DRAWINGS

Figure 1C:
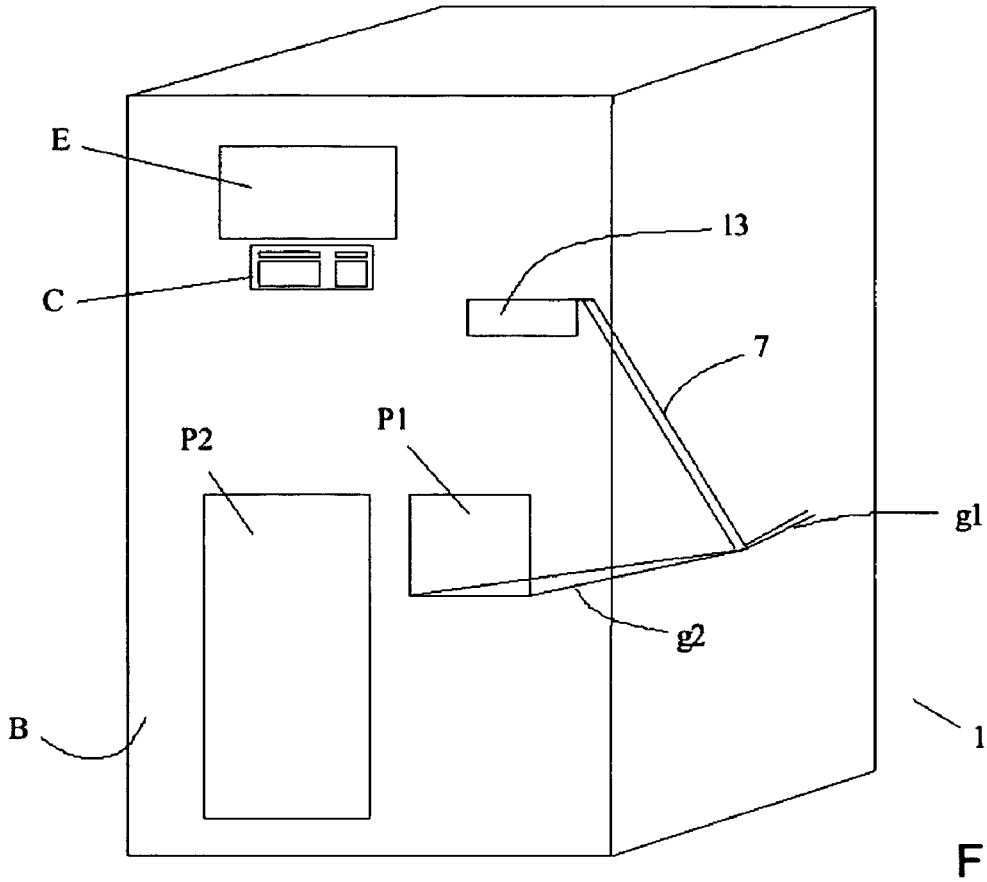
FIG. 1*a* illustrates the automatic machine according to the invention and its connection with a remote computer system.
FIG. 1*b* illustrates the automatic machine in an embodiment wherein the computer system is an internal computer built into the inside of the dispenser and communicates with a wireless external keyboard, FIG. 1*c* schematically illustrates an exemplary automatic machine according to the invention provided with a rear face accessible by a specialized operator, FIG. 1*d* schematically illustrates an internal exploded view of the automatic machine of FIG. 1*c*, on the front face side, FIG. 2*a* schematically illustrates, in a front view, the inside of the coin receiving and dispensing portion of the dispenser of the automatic machine according to the invention.

The invention will now be described with reference to FIGS. 1*a* to 3 and 7.

The automatic machine according to the invention consists of a dispenser (1) coupled to a computer system (3). The dispenser (1) according to the invention, illustrated in FIGS. 1*a*, 1*b* and 2*b*, has the shape of a parallelepipedal block mainly consisting of two portions (10, 11). A first portion (10) is for receiving and dispensing coins whereas a second portion (11) is for receiving and dispensing banknotes.

The first portion (10), larger than the second portion (11), notably comprises, as seen from the outside, a cover (100), an input keyboard (101) associated with a screen (102, 107), both fitted into the cover (100) and a housing (103) for positioning a cash drawer (2) intended for receiving coins. This housing (103) is formed with a hole pierced into the bottom of a side panel (104) with a larger surface, of the cover (100) throughout its length, this hole being of a sufficient size for introducing any type of cash drawer (2) into it. The housing (103) will also comprise a surface supporting the cash drawer in the position for receiving the coins. The cover (100) may be opened in order to fill the dispenser with coins, with banknotes, to maintain or to repair it. The keyboard (101) will be used i.e. for typing in a confidential code viewed on the screen (102, 107) or for selecting the type of operation desired by the user. This aspect of the invention will be described later on.

Figure 2A:
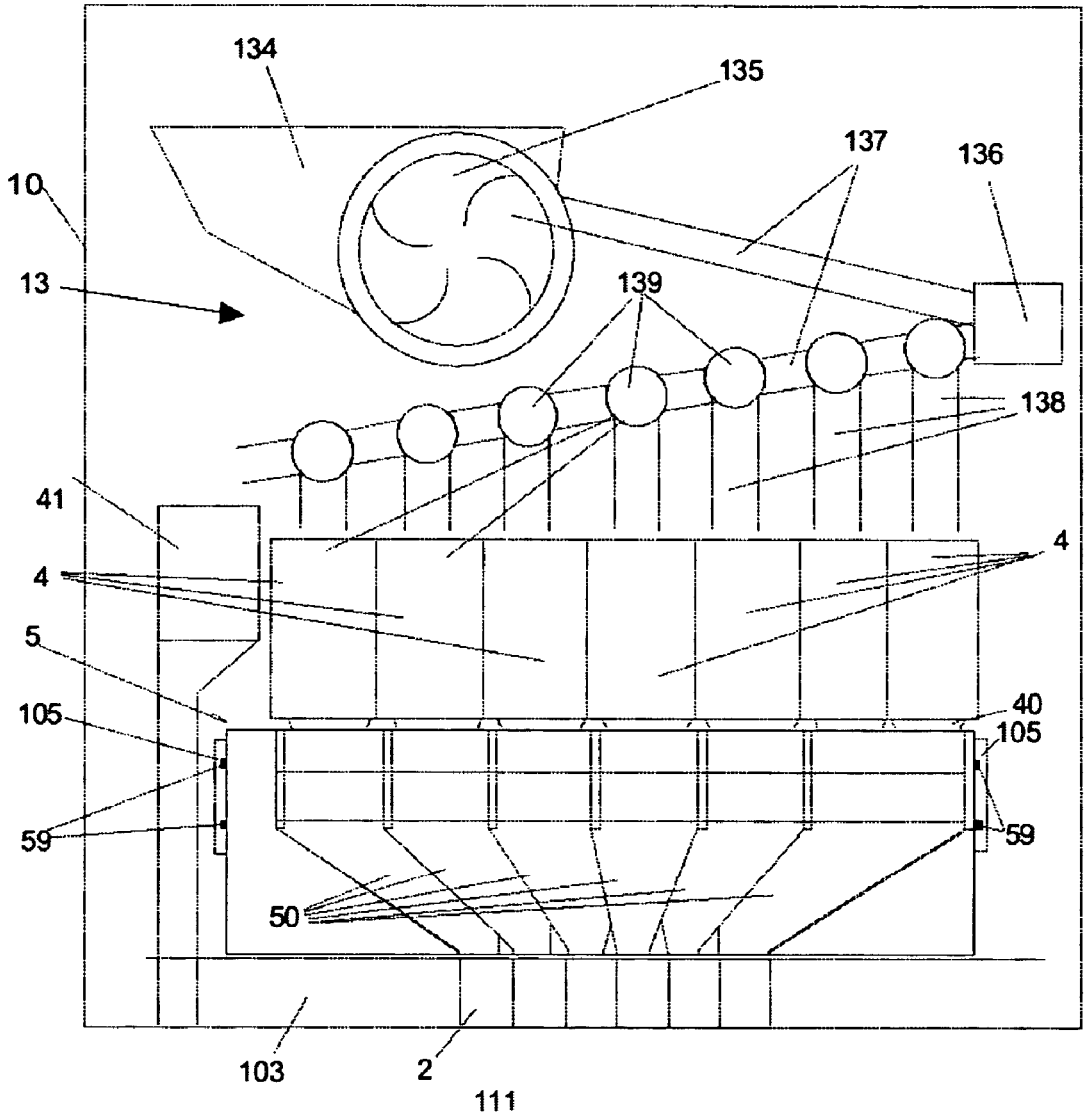
FIG. 2*b* illustrates in a side view, the layout of the depositing, raising, receiving and sorting, and dispensing devices of a dispenser of the automatic machine according to the invention.

A plurality of adjacent and aligned hoppers (4) is found inside the first coin dispensing portion (10), illustrated schematically in FIG. 2*a*. A hopper (4) is associated with a coin category. The hoppers (4) are all identical and do not have any particular structure depending on the category of coins which they receive. On the other hand, depending on the size of the category of received coins, the hoppers (4) will be able to store more or less coins.

Figure 2B:
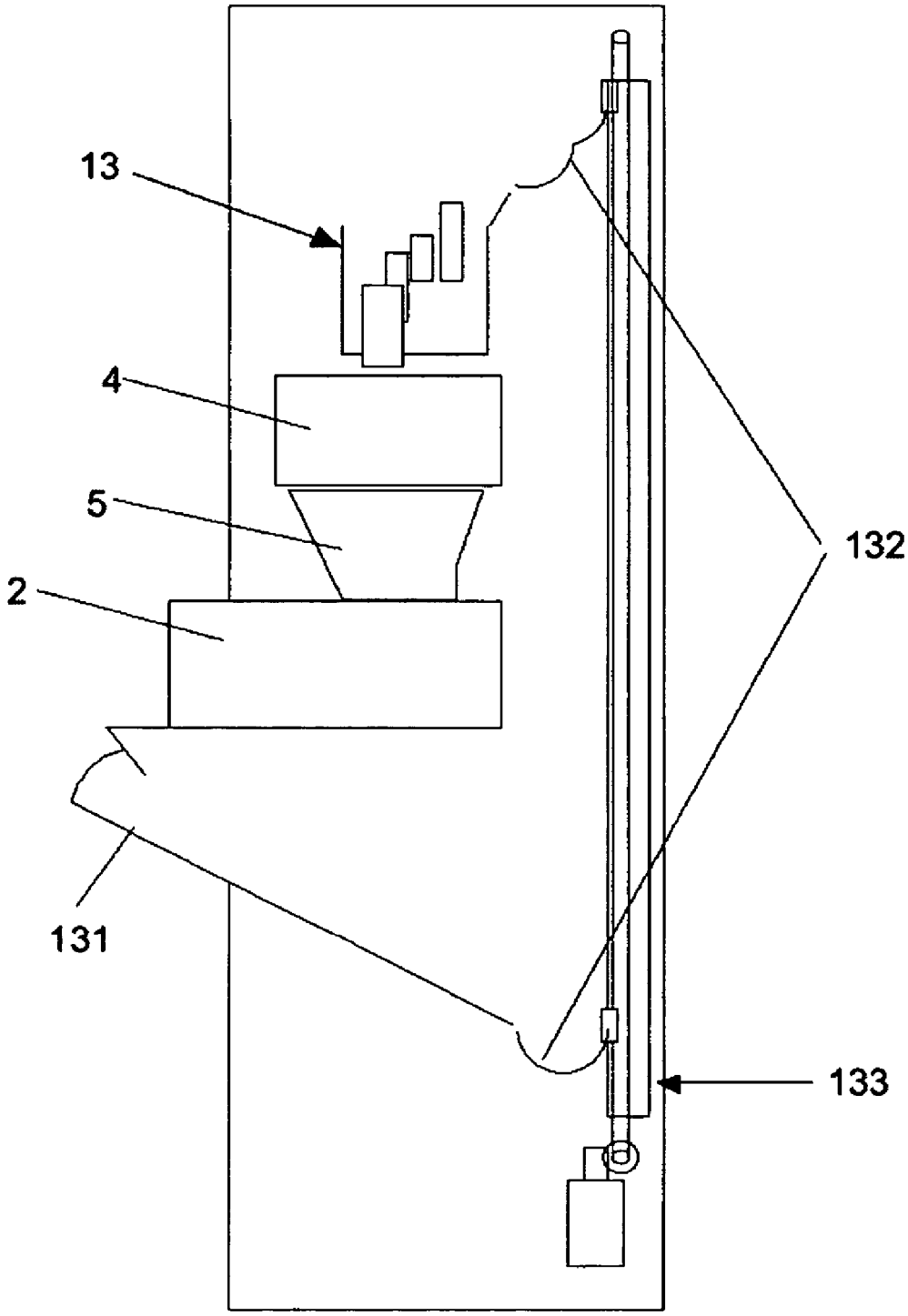

These hoppers (4) comprise an inlet for introducing coins and an outlet (40) for the coins. The coins are ejected one after the other by an ejector (not shown). According to the invention, the outlet (40) on each hopper is placed facing the inlet of a chute for dispensing the coins. The outlet of the dispensing chute is placed facing a compartment of a cash drawer (2). FIGS. 2*a* and 2*b* are schematic illustrations of the inside of the first portion (10) of the dispenser (1). In fact, the hoppers (4) have a more complicated structure as they notably integrate an ejector of a known type. Dispensing of the coins will be entirely managed by the management software. In particular, according to the invention, each hopper will have, near its outlet, a counter of the number of ejected coins. This counter will for example consist of a photo-electric cell detecting the passage of each ejected coin. The performed counting will immediately be taken into account by the software which will automatically debit what has actually been dispensed.

The whole of the chutes forms a single dispensing block (5) which is removable from the dispenser (1). The layout and the shape of the chutes in the dispensing block depend on the setting-up of the compartments within the cash drawer (2) into which the dispenser (1) is assumed to dispense coins. According to the invention, the first portion (10) of the dispenser (1) may therefore receive, through a coupling (105) and positioning system, different dispensing blocks (5) according to the configuration of the cash drawer (2) to be fed. This coupling system (105) for example consists of two nipples (59) positioned on the side of the dispensing block (5) and intended to slide in ramps formed inside the first portion (10) until they block the dispensing block (5).

In an alternative not illustrated here, several dispensing blocks with different geometries are available in the dispenser and may be interchanged by exchanging means such as a carrousel, actuated by the user or controlled by the computer system depending on the operation to be performed or on a type of cash drawer corresponding to an identified user, and stored as a parameter by the computer system.

The cash drawer (2) is intended to be inserted into the housing (103) provided in the first portion (10) of the dispenser (1) for receiving the coins. According to the invention, in each dispensing block (5), dispensing chutes (50) will have a layout suitable for the configuration of the cash drawer (2). In each dispensing block (5), the chutes (50) have a surface for forwarding the coins, orientated towards the vertical median plane of the dispensing block (5). The chutes (50) have an outlet with a smaller section than the section of the inlet of the chutes communicating with the outlet (40) of at least one hopper (4).

Figure 3:
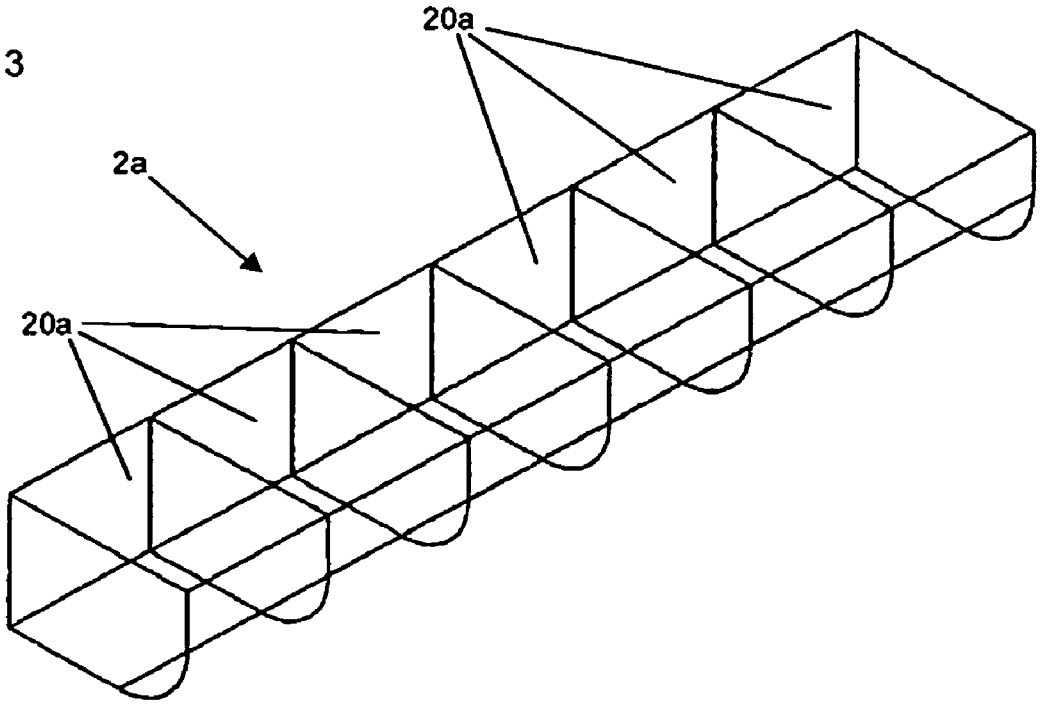
FIG. 3 illustrates a first type of cash drawer.
Figure 4A:
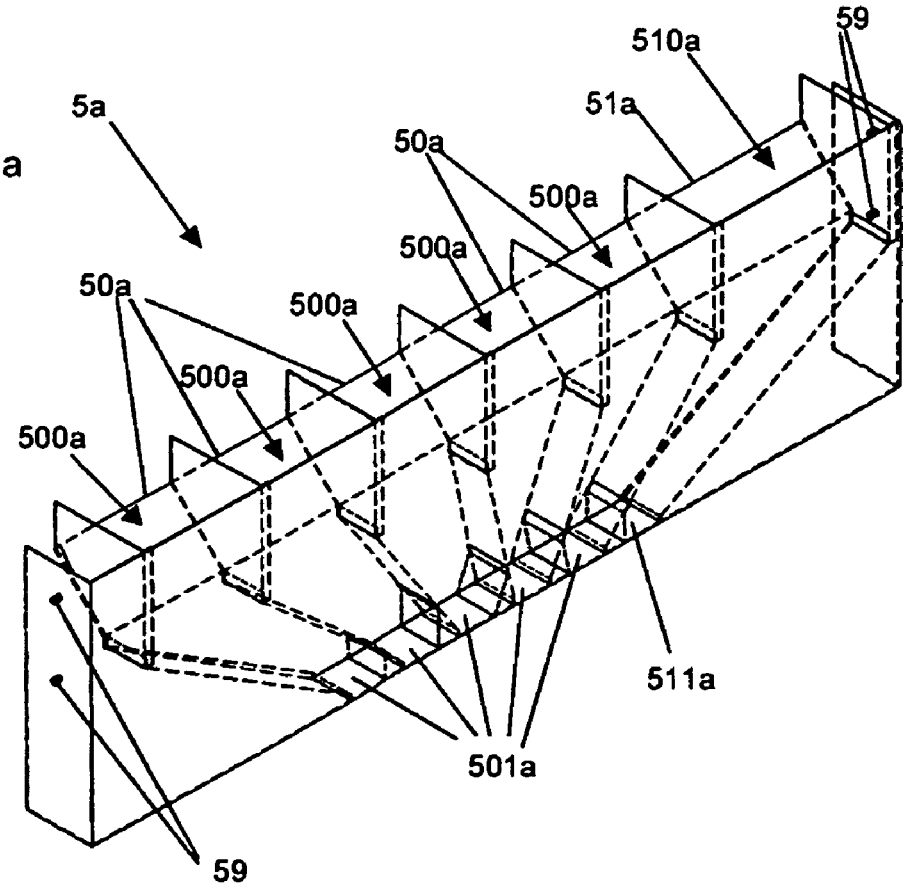
FIGS. 4*a*, 4*b*, and 4*c* illustrate in a perspective, top and front view, respectively, the dispensing block suitable for the first type of cash drawer.
Figure 4B:
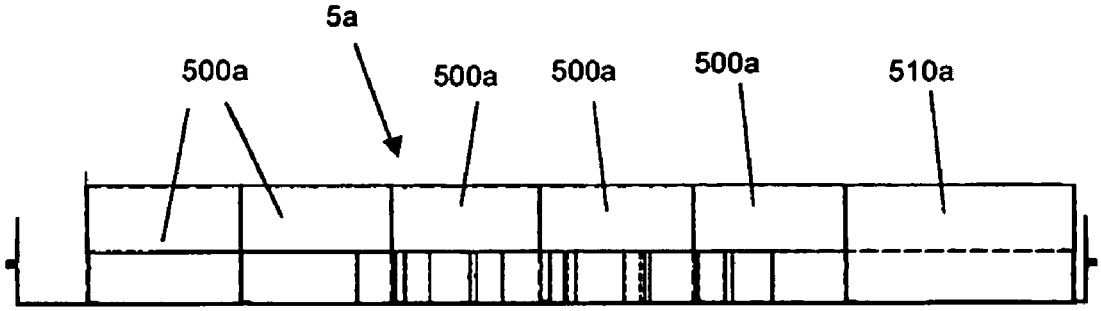
Figure 4C:
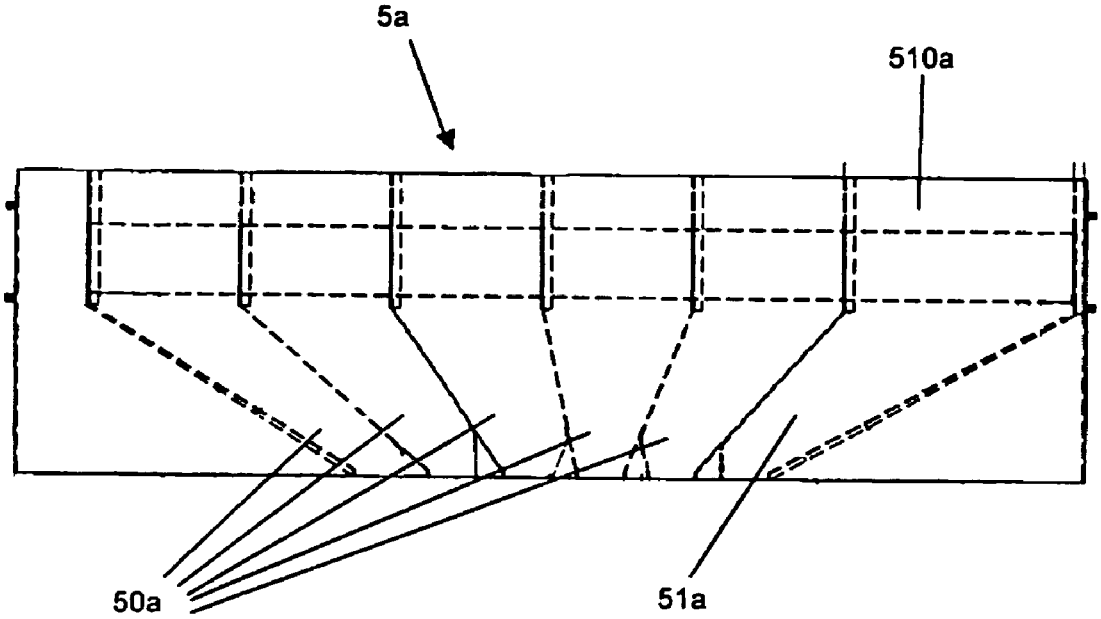

For example, a first type of cash drawer (2*a*) illustrated in FIG. 3, consists of a row of six identical compartments (20*a*). According to the invention, the dispensing block (5*a*), illustrated in FIGS. 4*a*, 4*b* and 4*c*, suitable for this cash drawer (2*a*) will comprise six chutes (50*a*, 51*a*) having adjacent and aligned inlets (500*a*, 510*a*) facing the outlets (40) of the hoppers (4) and the adjacent and aligned outlets (501*a*, 511*a*), each outlet (501*a*, 511*a*) being placed above a different compartment (20*a*) of the cash drawer (2*a*). This cash drawer (2*a*) only comprises six compartments (20*a*) for seven hoppers (4). Two hoppers (4) therefore dispense to a compartment of the cash drawer (2*a*) via a common dispensing chute (51*a*), the inlet of which (510*a*) is widened relatively to the inlets (500*a*) of the other chutes (50*a*). A compartment (20*a*) of the cash drawer (2*a*) will then receive coins from both hoppers.

Figure 5:
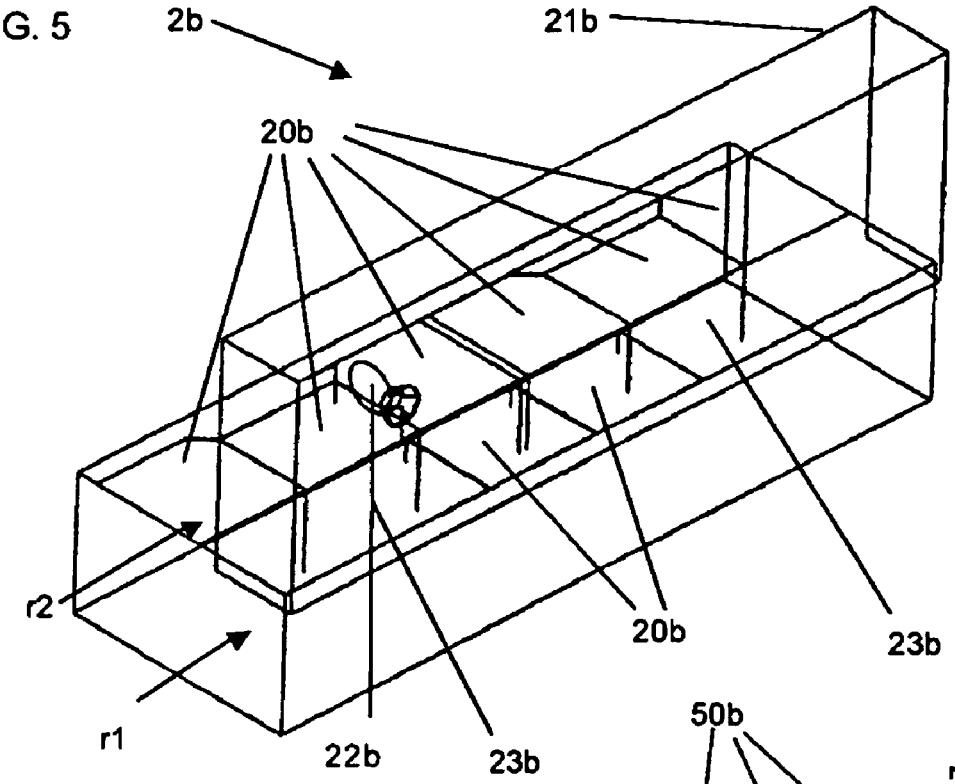
FIG. 5 illustrates a second type of cash drawer.
Figure 6A:
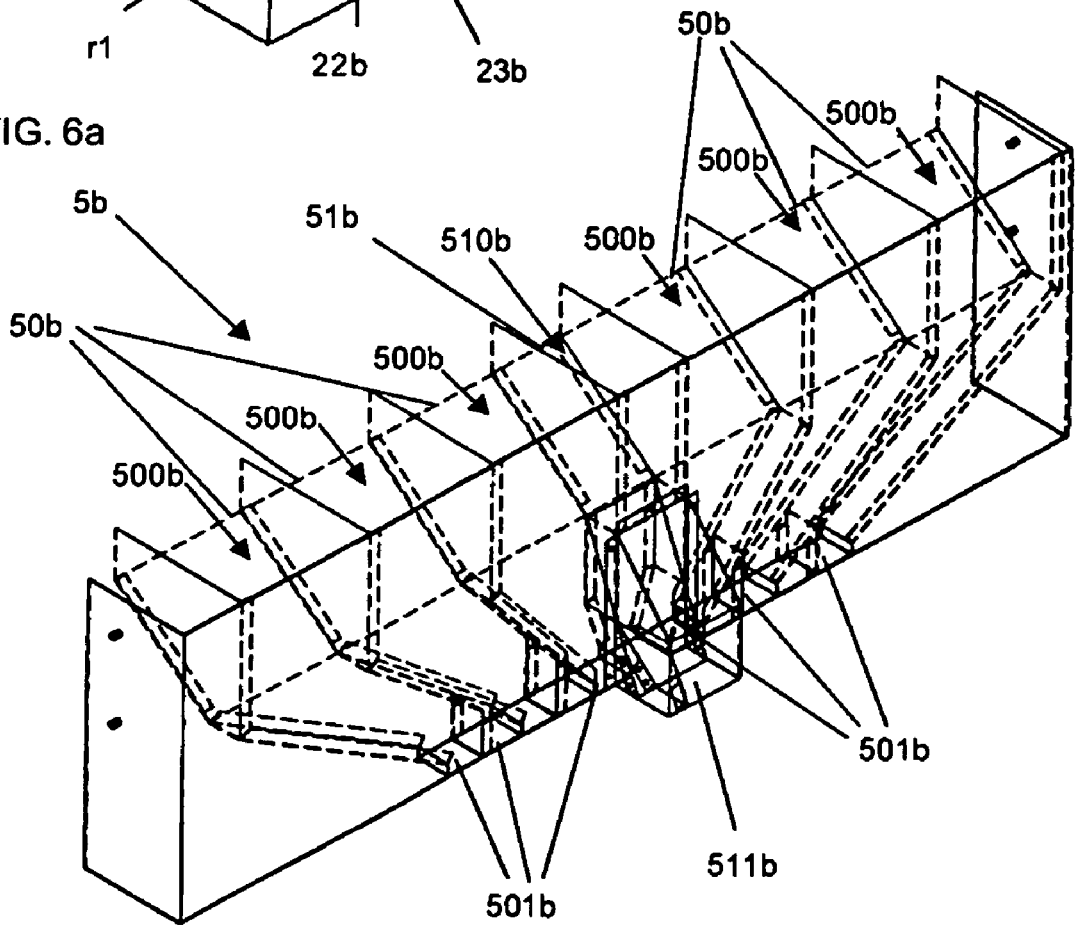
FIGS. 6*a*, 6*b*, and 6*c* represent in a perspective, top and front view, respectively, the dispensing block suitable for the second type of cash drawer.
Figure 6B:
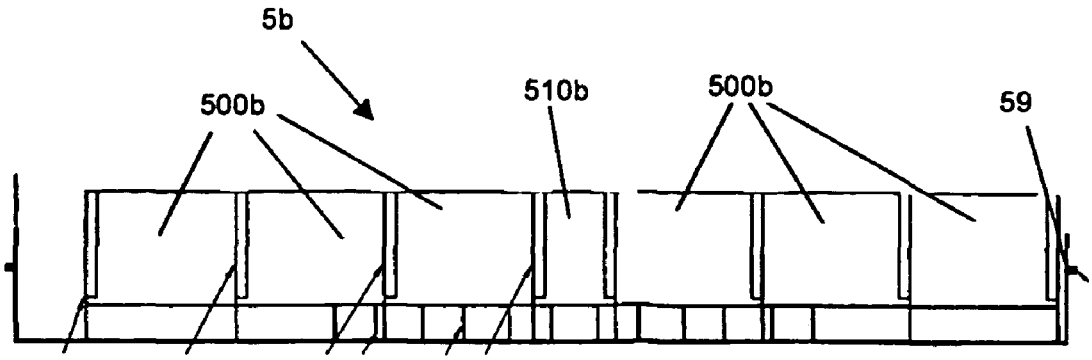
Figure 6C:
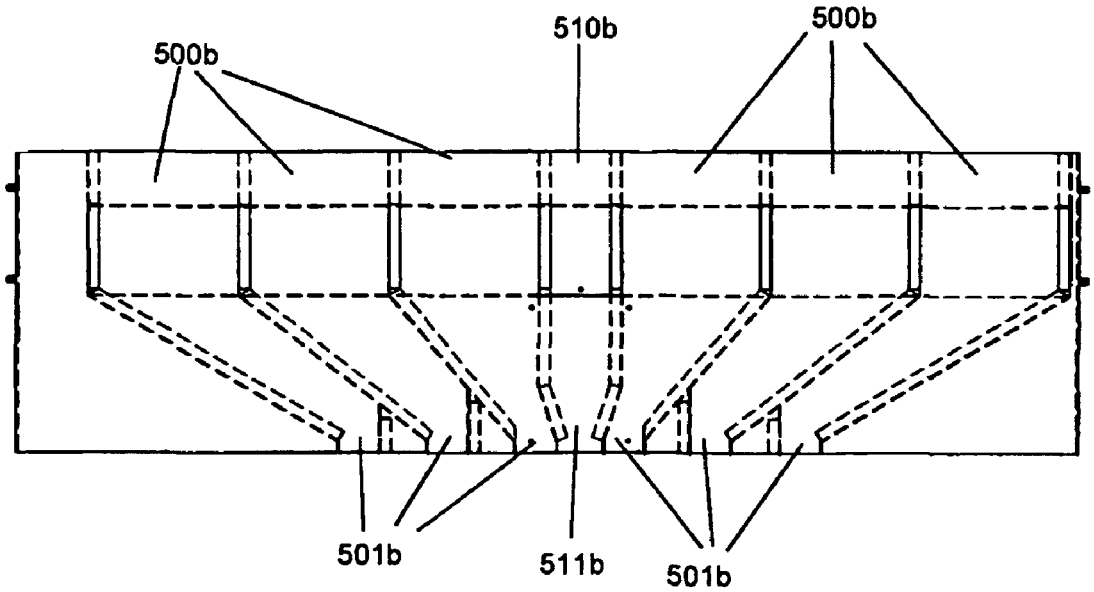

A second type of cash drawer (2*b*) is shown in FIG. 5. This cash drawer (2*b*) will for example comprise a lid (21*b*) which may be closed with a key (22*b*). It also comprises two rows (r1, r2) of compartments (20*b*). A first row (r1) comprises four compartments and a second row (r2) comprises six compartments (20*b*). The first row will for example comprise two identical central compartments (20*b*) held between two compartments (23*b*) of a larger size for storing banknotes for example. The six compartments (20*b*) of the second row (r2) and both compartments (20*b*) of the first row (r1) are intended to receive coins from the hoppers (4). The dispensing chutes according to the invention are laid out in order to feed these compartments (20*b*) of the cash drawer (2*b*). The dispensing block (5*b*) illustrated in FIGS. 6*a*, 6*b* and 6*c*, will comprise a chute (51*b*) for feeding both compartments (20*b*) of the first row (r1) and six chutes (50*b*) for feeding the compartments (20*b*) of the second row (r2). The inlets (500*b*, 510*b*) of the chutes (50*b*, 51*b*) are adjacent, aligned and each placed facing the outlet (40) of a hopper (4). The chute (51*b*) feeding both compartments (20*b*) of the first row (r1) is central. The outlet (511*b*) of this central chute (51*b*) is shifted relatively to the other outlets (501*b*) of the chutes in order to feed the compartments (20*b*) of the first row (r1) of the cash drawer (2*b*). The second row (r2) of the cash drawer (2*b*) will for example be the first to be introduced into the housing (103) provided for positioning the cash drawer (2*b*). The outlet (511*b*) of the central chute (51*b*) is shifted outwards when the dispensing block (5*b*) is coupled by the coupling system (105) in the first portion (10) of the dispenser. This central chute (51*b*) because it feeds both compartments (20*b*) of the first row (r1) of the cash drawer (2*b*), will have an outlet (511*b*) with a larger section than that of the other outlets (501*b*) of the chutes (50*b*) each only opening into one compartment (20*b*) of the cash drawer (2*b*).

Figure 7:
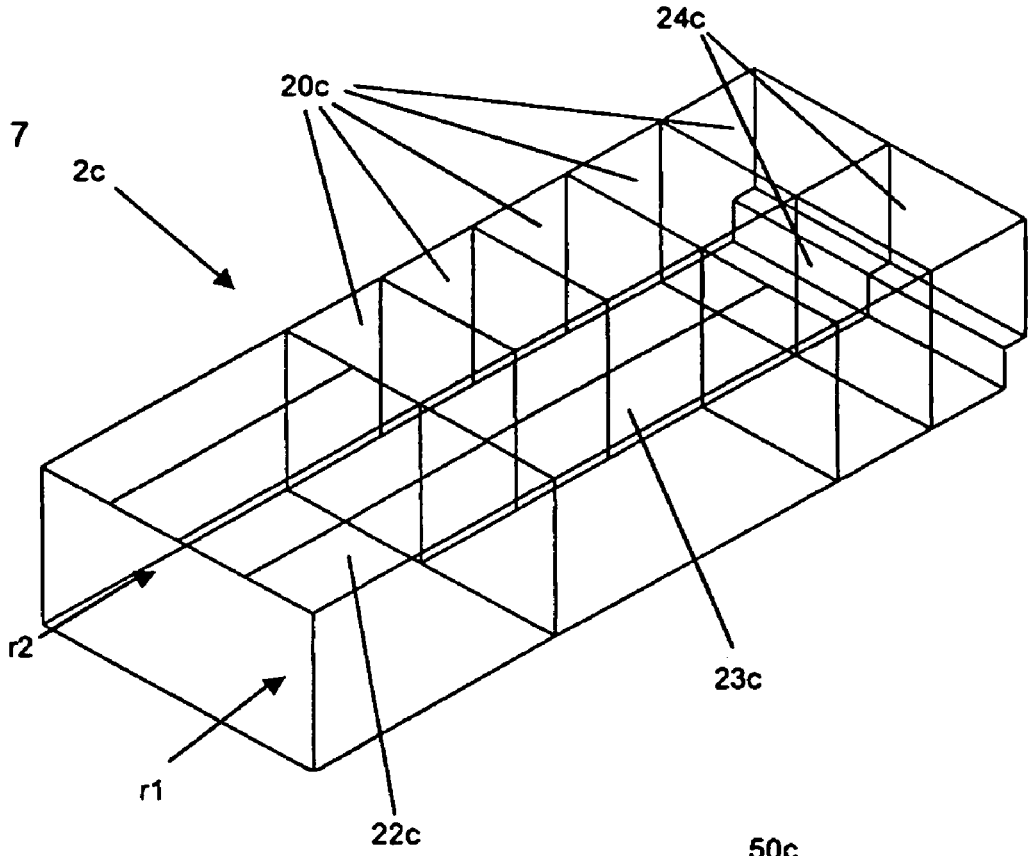
FIG. 7 illustrates a third type of cash drawer, FIGS. 8*a*, 8*b*, and 8*c* respectively illustrate in a perspective, top and front view, the dispensing block suitable for the third type of cash drawer.
Figure 8A:
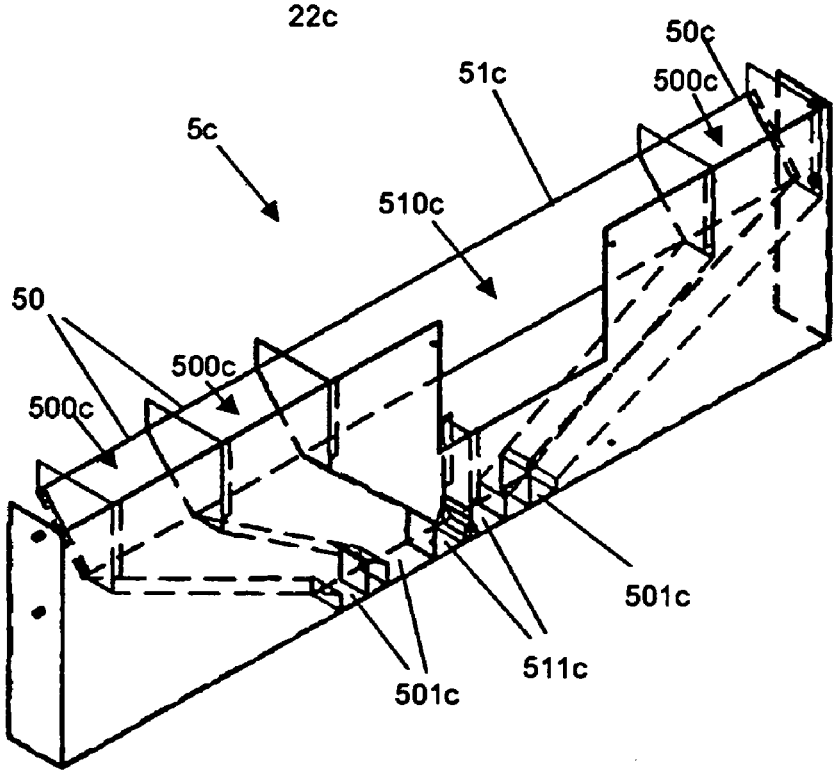
Figure 8B:
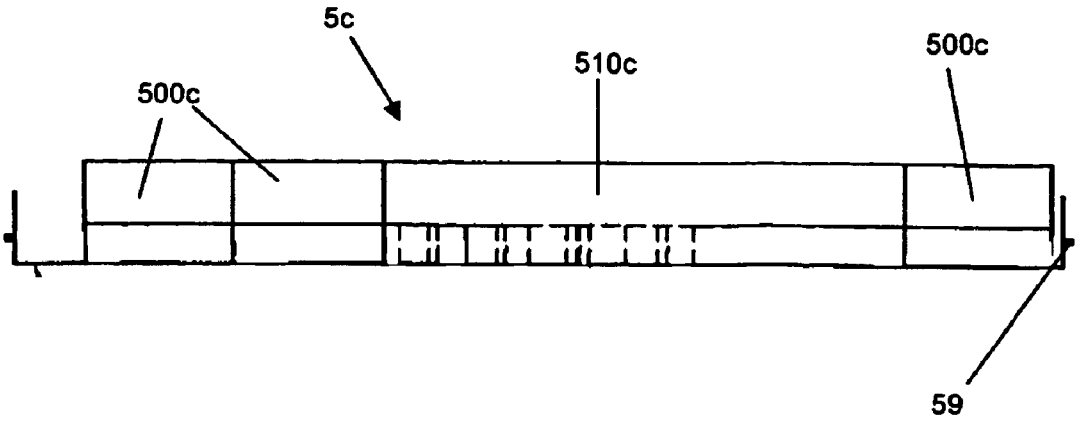
Figure 8C:
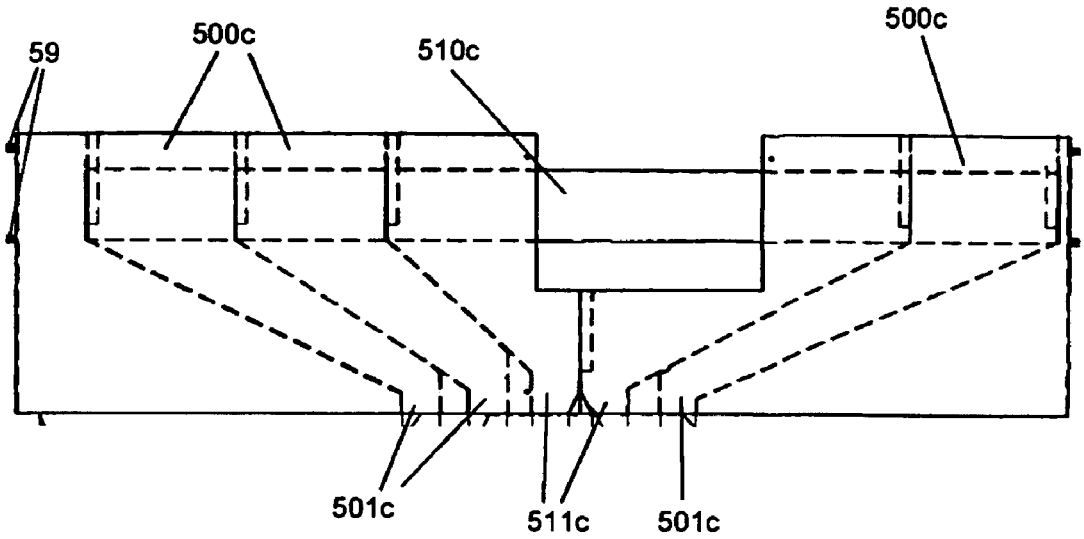

A third type of cash drawer (2*c*), illustrated in FIG. 7, also comprises two rows (r1, r2) of compartments. Both rows comprise a large common compartment (22*c*). A first row (r1) comprises, in addition to this common compartment (22*c*), three other aligned compartments. Among these three compartments, two (24*c*) are identical and a last one (23*c*) is of a larger size than the other two. The second row (r2) comprises in addition to the common compartment, five identical adjacent compartments (20*c*). These last five compartments (20*c*) are the ones which are fed by the hoppers (4) of the dispenser (1) via the chutes laid out as a block. According to the invention, the corresponding dispensing block (5*c*), illustrated in FIGS. 8*a*, 8*b*, and 8*c*, will comprise four adjacent inlets (500*c*, 510*c*). According to the invention, the dispensing block (5*c*) will comprise three inlets (500*c*) of chutes (50*c*) with identical sections, two of these inlets being at one end and the other of these inlets being at the other end of the dispensing block (5*c*). This group of two chutes placed at one end and of this chute placed at the other end are separated by the last chute (51*c*) having an inlet (510*c*) with a larger section in order to collect coins from several hoppers (4) of the dispenser (1), for example from four hoppers (4) of the dispenser. The outlets (501*c*, 511*c*) of these chutes (50*c*, 51 *c*) are also adjacent and aligned and are five in number, each being placed above a compartment (20*c*) of the cash drawer (2*c*) to be fed. The outlet (511) of the chute (51*c*) with a widened inlet according to the invention is separated into two distinct outlets for feeding two distinct compartments (20*c*) of the cash drawer (2*c*). Both of these compartments of the cash drawer may each comprise for example two categories of coins from two hoppers (4) of the dispenser (1). The dispenser (1) may also have several hoppers (4) comprising the same category of coins.

Figure 9:
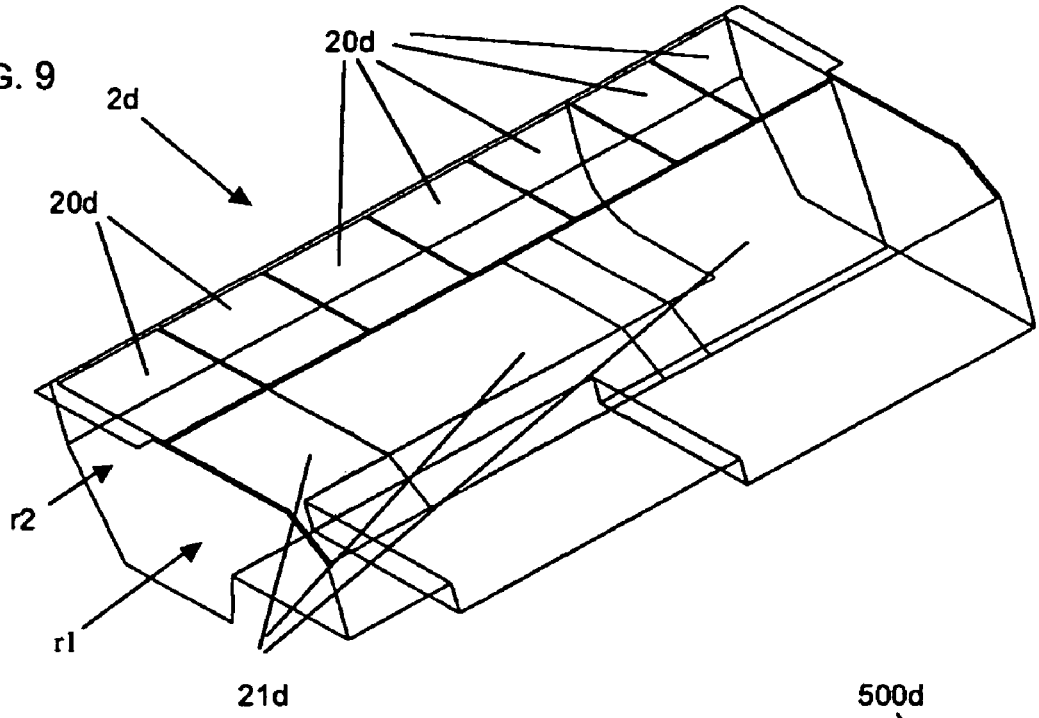
FIG. 9 illustrates a fourth type of cash drawer.
Figure 10:
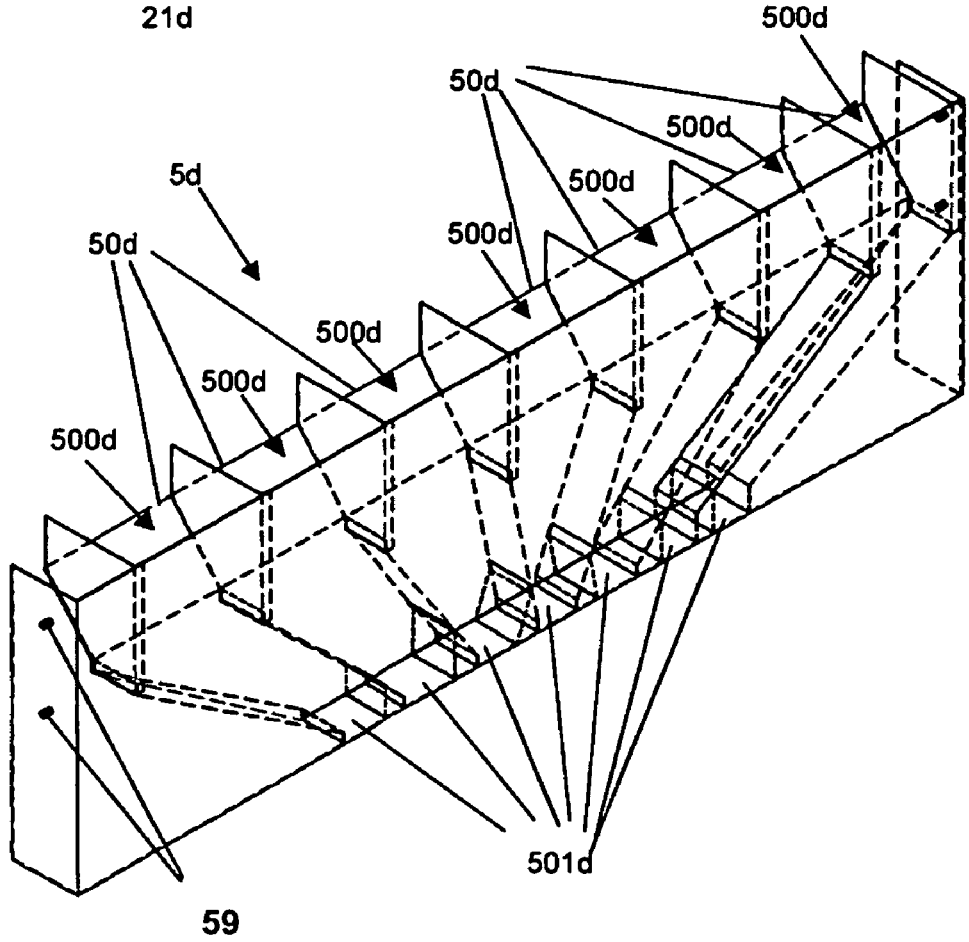
FIG. 10 illustrates in a perspective view the dispensing block suitable for the fourth type of cash drawer.

Another type of cash drawer (2*d*), illustrated in FIG. 9, will mainly comprise two rows (r1, r2) of compartments. A first row (r1) comprises large size compartments (21*d*) for storing banknotes and other bank card receipts. A second row (r2) for storing coins comprises, as illustrated in FIG. 9, seven identical adjacent and aligned compartments (20*d*). According to the invention, the dispensing block (5*d*) for feeding the compartments of the cash drawer will include seven chutes, as illustrated in FIG. 10. The chutes (50*d*) will be laid out according to the invention in order to feed these seven compartments (20*d*). The dispenser (1) will comprise as described earlier, seven hoppers (4) for example, as illustrated in FIG. 2*a*. A hopper (4), comprising a category of coins, will feed one compartment (20*d*) of the cash drawer (2) via a chute (50*d*) of the dispensing block (5*d*). According to the invention, the chutes will have aligned adjacent inlets (500*d*), each facing the outlet (40) of a hopper (4) and outlets (501*d*), also adjacent and aligned, each opening into a different compartment (20*d*) of the cash drawer (2*d*).

According to the invention, all these dispensing blocks (5*a*, 5*b*, 5*c*, 5*d*) are of the same dimensions in order to be coupled in the dispenser (1) under the set of hoppers (4). The dispensing block (5*a*, 5*b*, 5*c*, 5*d*) is removable from the dispenser (1) and interchangeable according to the type of cash drawer (2*a*, 2*b*, 2*c*, 2*d*) to be fed. The dispensing block (5*a*, 5*b*, 5*c*, 5*d*) will be positioned by the coupling system (105) in the dispenser (1) without affecting the internal or external structure of the dispenser (1). According to the invention, it will therefore be possible to adapt the dispenser to the feeding of any type of cash drawer by only changing the dispensing block. The different types of cash drawer and dispensing blocks shown above are by no means limiting, other cash drawers may be contemplated in association with other suitable dispensing blocks.

According to the invention, the second portion (11) of the dispenser (1) will comprise a dispensing module using one or more cassettes, for example two cassettes, each containing only one category of note. The cassettes may also be replaced with storage and dispensing rolls. The second portion (11) of the dispenser will then comprise means for picking up and forwarding notes into a cassette, for example consisting of rolls allowing the notes to be forwarded towards the outside. These means for dispensing notes, like those for the coins, may comprise a cell for counting the number of actually dispensed notes, this value being recorded in the computer system (3). The computer system (3) will store in its database (db1) the number of notes which the dispenser (1) should deliver for each category of notes. The notes will thereby be processed like the coins and the procedure of the computer system (3) will be similar to the one used for dispensing the coins. The dispenser will therefore deliver the number of notes, stored for each category of notes. The note dispenser may for example store up to 4,000 banknotes. During each operation including dispensing, it will be possible to assign to each user, the value in notes which one wishes to dispense.

In an alternative (not shown), the hoppers for storing coins and the cassettes/rolls for storing notes include closing means as well as locking or sealing means electrically or mechanically controlled during the opening of the dispenser (1), or controlled by the computer system (3). One or more hoppers or cassettes are then fixed into the dispenser by reversible fixing means, so as to allow one or more of them to be extracted together or separately. During a feeding or emptying operation of the automatic machine, it is then possible for a transfer operator to replace one or more hoppers, present in the dispenser with other hoppers with determined contents, and to again set the automatic machine into operation with the new hoppers, without himself/herself having access to the contents of the hoppers. For this, the cassettes or hoppers are closed upon opening the cover, or before this operation, and they are extractible only once they are locked or sealed. These cassettes or hoppers are then replaced with other closed and locked or sealed cassettes, which cannot be unlocked or unsealed, and then opened, after fixing them into the dispenser or after closing the cover of the dispenser.

In the upper portion of the first portion (10) of the dispenser (1), a change receiving device (13) is positioned above the storage hoppers, as schematically illustrated in FIGS. 2*a* and 2*b*. In the case of an operation comprising a deposit of coins by a user, this coin receiving device receives the coins in bulk, recognizes them and sorts them out by type or by value, counts them for each type or value, and then forwards them by gravity to the storage hoppers (4) assigned to each of the types or values of the coins. The received and recognized coins, when they correspond to stored types or values, may thus be redispensed during an operation comprising a dispensing of coins, subsequently or during the same operation. An extra hopper (41) will receive the unrecognized coins or the recognized coins which do not correspond to a type or a value assigned to a storage hopper (4), or the excess coins with respect to the storage capacities of the other storage hoppers (4).

Typically, this device (13) for receiving coins comprises a receiving bin (134) receiving the coins to be sorted, in which a recessed loading disk (135) rotates, which takes the coins one after the other into the bin, to the last, in order to bring them to the top of a tilted ramp (137) running above chutes (138) leading to the different hoppers (4, 41). At the inlet of this tilted ramp (137) a recognition device (136) is found, of a known type, which recognizes the type or the value as well at the authenticity of the coins brought in by the loading disk (135). Depending on the recognition performed by the recognition device (136), different actuators (139) positioned along the ramp and controlled by the computer system (3) or by control means depending on the recognition device (136), eject each coin towards the chutes leading to the hopper of the recognized type or value. A counting device of a known type (not shown) for example with an optical cell, which contains the count of the number of entered coins in each hopper, is found at the inlet of each chute and of the ramp. The information from the recognition device and that from the various counting cells are transmitted to the computer system, which mutually corroborates them and uses them for calculating and storing the value and the composition of the set of coins deposited by the user. The unrecognized coins fall at the end of the ramp (137) and are received in an eighth hopper (41) where they may be stored or given back to the user.

In the low portion of its face, the first portion of the dispenser (1) has a hatch (131) which may be unlocked, for example upon a command from the computer system, and where the user may dump the coins which he/she wants to deposit. These coins then fall down into a mobile receptacle (132) for example with a capacity of about 1,000 coins, which is displaced upwards by actuating means (133) within about 4 seconds. This mobile receptacle then forms a lift which will bring the dumped coins up to the bin located at the inlet of the coin receiving device (13). This lift allows the coin receiving device to be positioned above the hoppers, while allowing the user to easily pour the coins into a sufficiently low hatch to limit the required efforts and movements. With such an arrangement, it is thereby possible to obtain a dispenser with a compact shape and reduced bulk and with satisfactory ergonomics.

In its second portion (11), the dispenser (1) comprises a device (14) for receiving banknotes. In the case of an operation comprising a deposit of banknotes by a user, this note receiving device receives the notes one by one, recognizes them, and sorts them by type or by value, counts them for each type or value, and then forwards them into the storage cassettes and/or rolls, assigned to each of the types or values of notes. The received and recognized notes, when they correspond to the stored types or values, may thereby be redispensed during an operation comprising a dispensing of banknotes, subsequently or during the same operation. A third cassette or roll will receive the unrecognized notes or the notes which are recognized but do not correspond to a type or value assigned to a storage cassette or excess notes with respect to the storage capacities of the other storage cassettes/rolls.

Typically, this device (14) for receiving notes comprises an aperture for inserting notes into the front face of the dispenser (1). The user introduces one by one the notes which he wants to deposit, and the latter are driven by rubber rolls successively along a forwarding path. A device of a known type for recognizing notes, for example with optical reading under several illuminations, using lights with different spectra, is positioned on this path. Depending on the type or the value recognized for each note introduced by the user, said note is then directed to the corresponding cassette or roll. In an alternative not shown, the automatic machine includes an unbundling device in which the user deposits the notes to be recognized as non-attached stacks or bundles. This unbundling device extracts the notes from the introduced bundle, one by one, and sends them to the recognition device described above. A counting device, for example with an optical cell, which contains the count of the number of notes entered into each cassette, is found at the inlet of each cassette or roll or of the note receiving device (14). The information from the recognition device and that from the different counting cells are transmitted to the computer system, which mutually corroborates it and uses it for calculating and storing the value and possibly the composition of the whole of the notes introduced by the user.

Because certain operations comprise the deposit by a user of coins or notes, including at least one portion which may be reused for performing a dispensing operation, the automatic machine according to the invention may operate with an autonomy which is less limited by the capacities of its storage means.

Figure 1D:
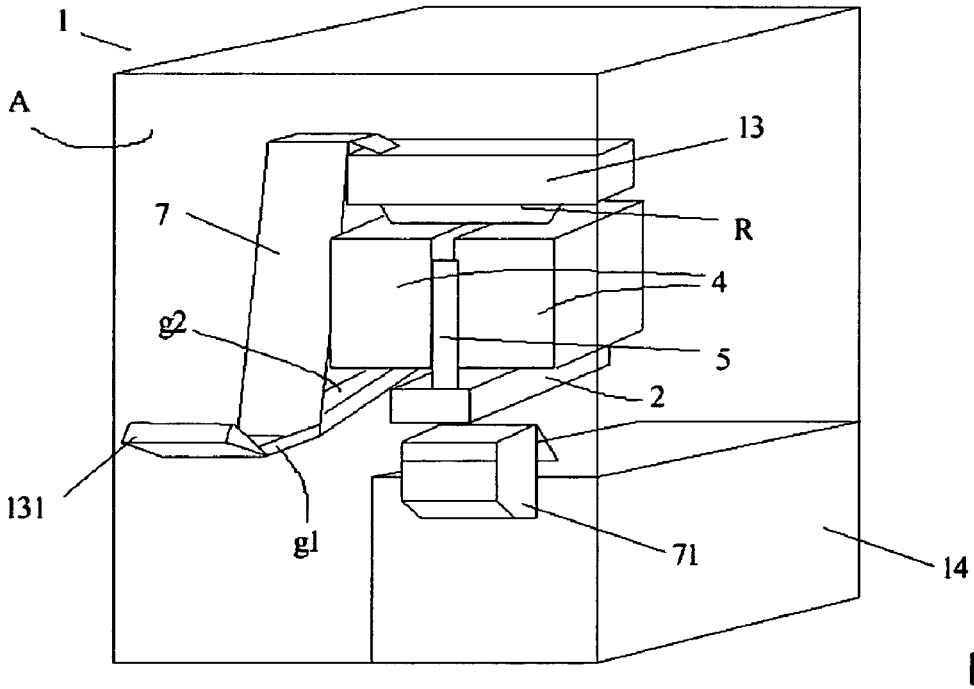
Figure 1A:
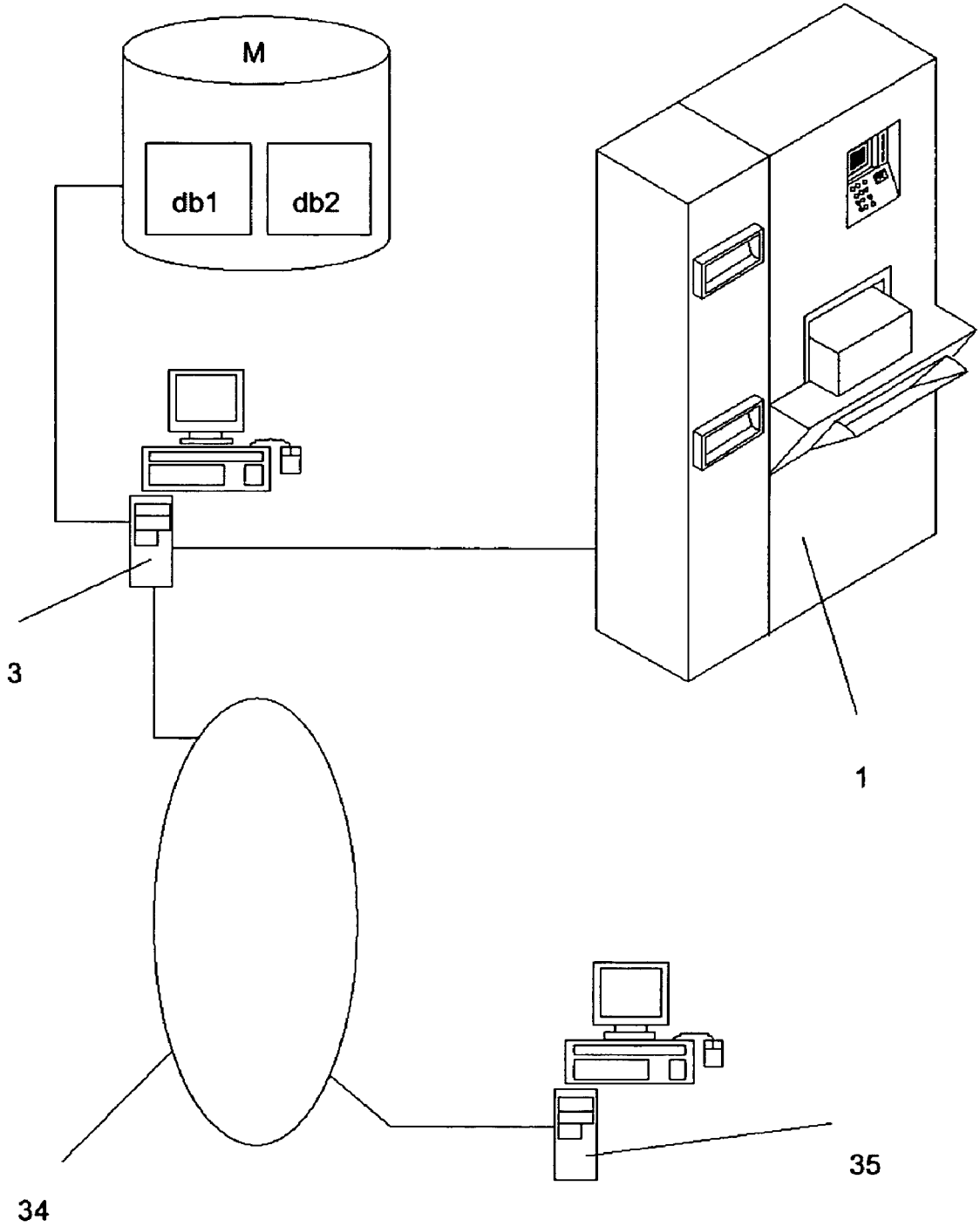
Figure 1B:
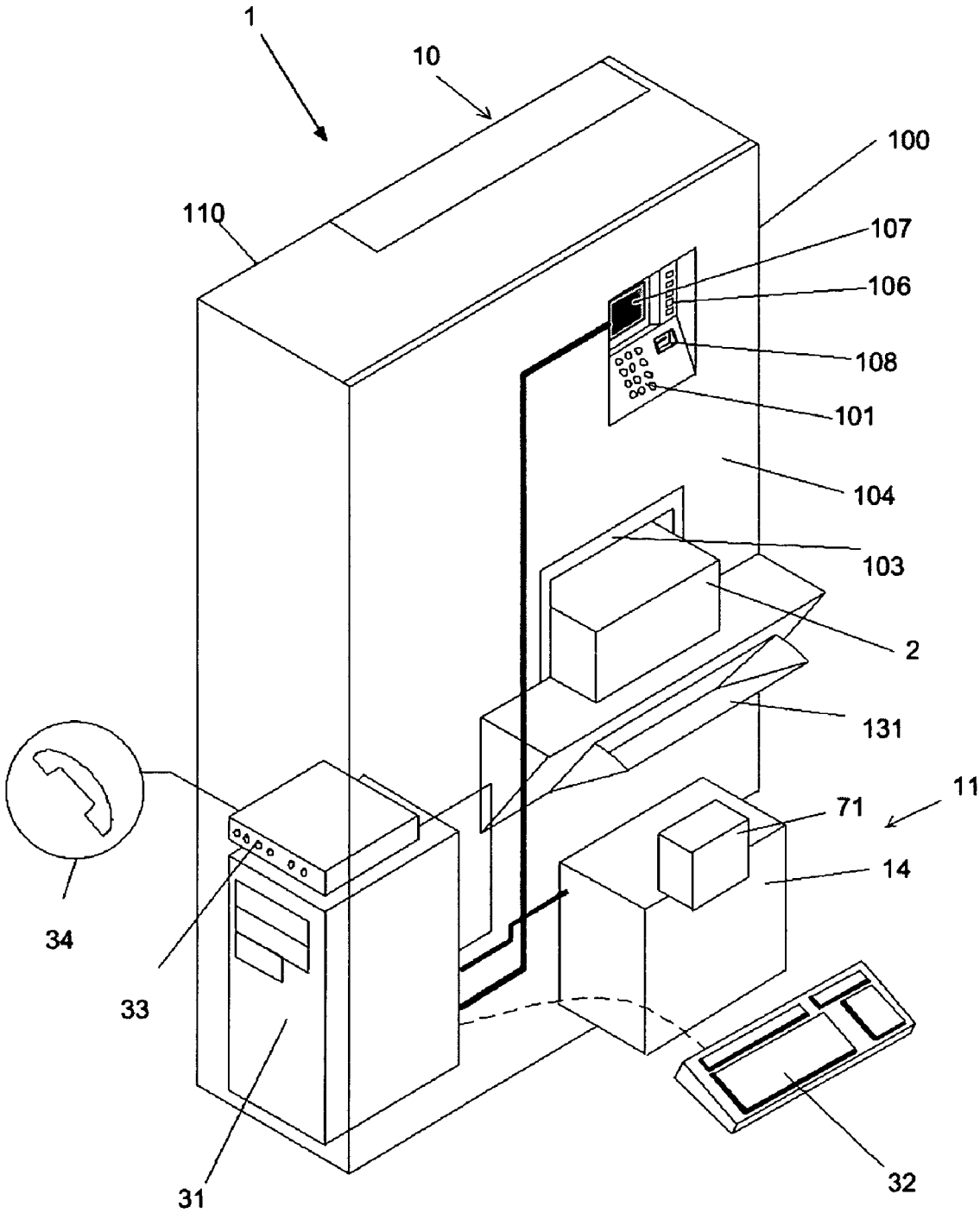

According to the invention, the dispenser (1) is controlled by a computer system (3) as illustrated in FIGS. 1*a* and 1*b*, executing software for managing operations which may be performed by the automatic machine upon demand from a user of this automatic machine. This software includes a management and parameterization portion with which settings adapted to the way the automatic machine is used and to the users of this automatic machine may be stored. This software also includes an operating portion, which provides the interface between the automatic machine and the user, for selecting and controlling the operations to be performed.

In the embodiment of FIGS. 1*c* and 1*d*, the dispensing device (1) includes a front face (A) including the interface between the automatic machine and the user as well as a rear face (B) provided with another interface provided for an operator such as a security guard. The front face (A) includes first components (71) for deposit and withdrawal of notes, as well as second components (131, 2) for deposit and withdrawal of coins. The rear face (B) opposite to the front face (A) includes an interface provided for unlocking at least one first access (P1) from the rear to the coin storage means and at least one second access (P2) from the rear to the note storage means. The interface for the unlocking may for example be actuated only after introducing an identification code of an operator and checking this code with a list of codes, stored by the computer system (3).

With reference to FIGS. 1*c* and 1*d*, raising means (7) comprising a coin lifting unit, are interposed between a first coin forwarding unit (g1) connected to a front port of the automatic machine, on the one hand, and on the other hand a coin forwarding unit (g2) connected to a rear port of the automatic machine. It is understood that an operator intervening from the rear of the dispensing device (1) may simply pour the coins into the second forwarding unit (g2), consisting for example of a chute, which brings the coins to the base of the raising means (7) being used for supplying a sorter with coins or more generally a coin receiving device (13) equipped with a coin distributor unit (R) for selectively feeding the hopper (4) sets. The raising means (7) for example comprise a band elevator provided with a base with the function of supplying the band with coins from either one of the front and rear forwarding units (g1, g2). The first coin forwarding unit (g1) receives the coins from a hatch (131) provided at the front of the dispenser (1) and forwards the received coins towards the base of the raising means (7).

The first access (P1) form the rear comprises an access hatch communicating with the second forwarding means (g2) as illustrated in FIG. 1*d*. The hatch may be unlocked subsequently to an identification step of the operator, for example by identifying a code, a card, or any other identification means, allowing access to be authorized. The unlocking may concern not only the access hatch for loading the coins but also the second access (P2) from the rear. This second access (P2) for example comprises a door for accessing a safe for storing notes or an analogous note receiving device (14). Said safe may be equipped with note cassettes or rolls, made translationally mobile on slides in order to allow said cassettes to be removed towards the rear by the operator.

At least one representative code of each of the cassettes or rolls is provided for example so that it is read by reading means of the rear interface which may thereby identify each cassette or roll and the amount of the contents corresponding to the identified cassette/roll. Said interface may therefore associate at least one code with each of the cassettes or rolls.

With reference to FIG. 1*c*, the interface provided on the rear face (B) includes a display screen (E) and input means (C), such as a keyboard or a tactile screen interface, for notifying to the computer system (3) a coin withdrawal or provision operation on the one hand, and a note withdrawal or provision operation on the other hand. The screen (E) and the input means (C) are connected to the computer system (3) which uses said storage means of the system (3) for storing the data representing the amount from the notified operations and data representing the identity of the operator having performed the operation. The identifiers of the operator are for example stored during an initialization or secured configuration phase.

It is understood that the automatic machine has means for checking the withdrawn or provided amounts by performing the "counting" of coins and notes. Said checking means are connected to the front face interface and to the rear face interface respectively in order to perform a check of a first total amount corresponding to the coins present in the automatic machine, and of a second total amount corresponding to the notes present in the automatic machine. For operations taking place from the rear of the automatic machine, the counting takes into account the provision or withdrawal of amounts of the notified operations. Similarly, the counting takes into account the provision or withdrawal of amounts of the operations performed via the front interface by the user lambda.

With reference to FIG. 1*b*, the management and parameterization portion for example is mainly accessible for the user by means of a keyboard (32) communicating with the computer system (3), or is accessible from another computer system (36) via a computer communication through a computer network (34), for example via Internet, or a telephone link (65) by using a modem (33).

The operating portion is directly used by the user of the automatic machine, for performing an operation and it communicates with him/her via a display screen and input means accessible to the user, on the front face side. These input means may for example be a reduced keyboard (101) positioned on the face of the dispenser or a screen (107) displaying different choices on different areas of the screen and keys (106) external to the screen, positioned facing these different areas, or a tactile screen detecting contact of the finger on the screen at the location of one of the these areas.

According to an alternative, this computer system (3) may manage several dispensers of the type of the invention at the same time.

This software will allow the managing of the different operations which the automatic machine may achieve, in particular deposit of takings or withdrawal of funds, simple counting of coins, purchase of change, direct dispensing of till cash amounts, new readjustments of till cash, or deposit of till cash to have it counted and restoration of readjusted till cash.

Figure 11A:
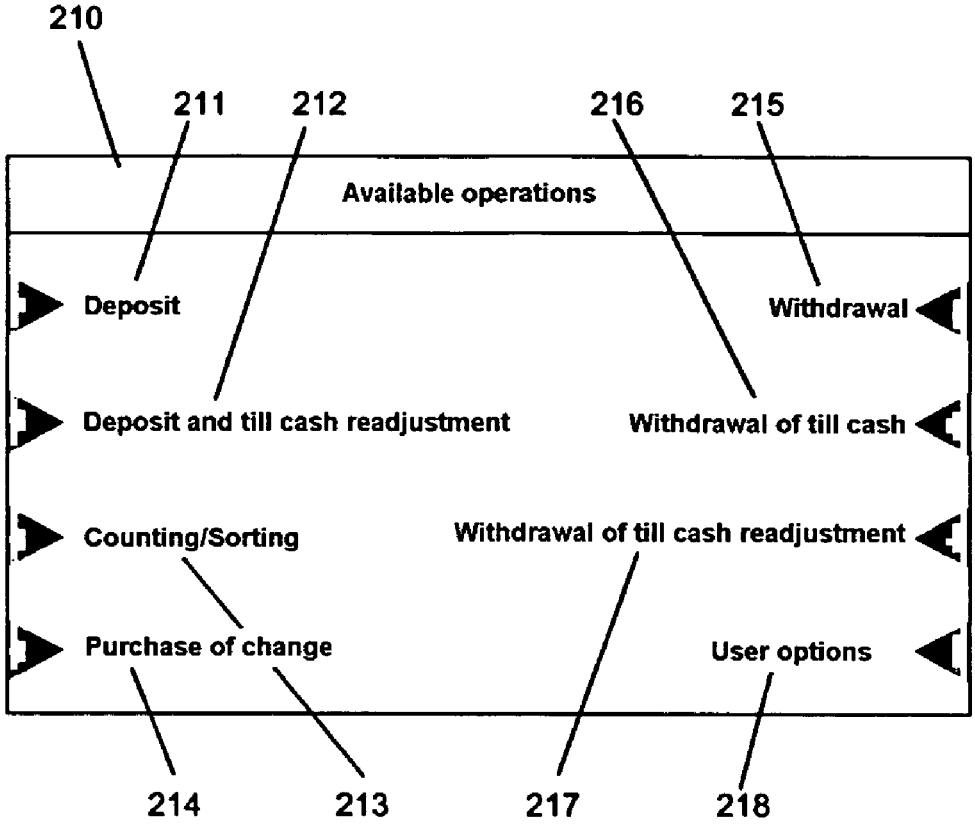
FIG. 11*a* illustrates a choice main screen among the available main operations.
Figure 11B:
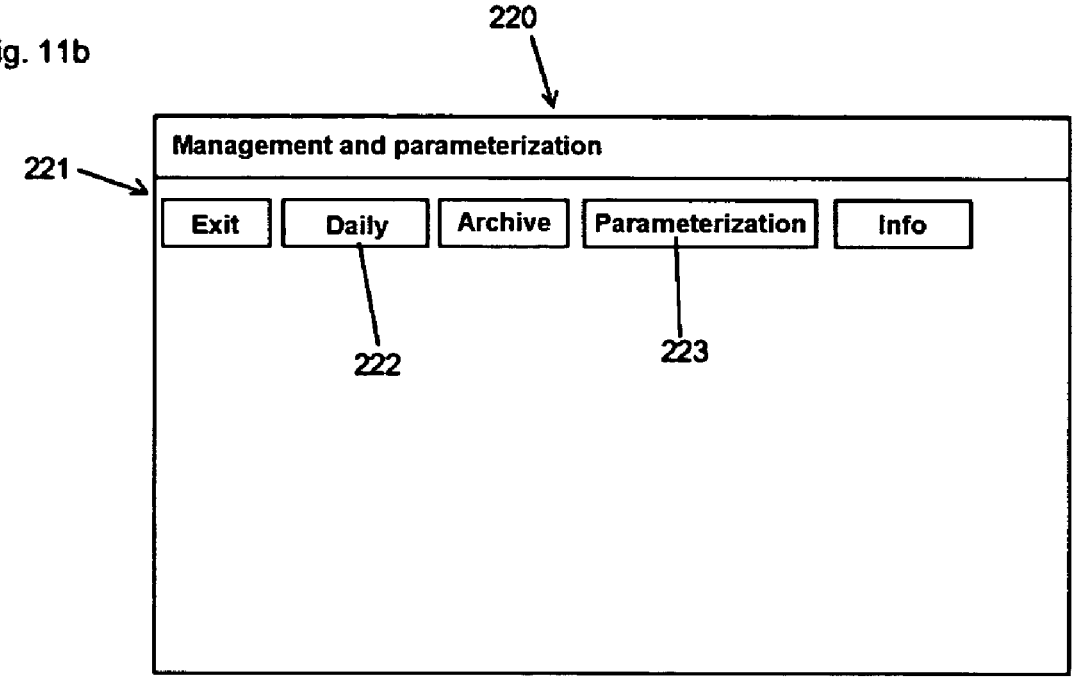
FIG. 11*b* illustrates a main screen for managing and parameterizing the automatic machine according to the invention.

In the portion of the software performing the management and parameterization of the automatic machine, with a main management screen (220), illustrated in FIG. 11*b*, it is possible to access the different functionalities of the software. For this, this screen (220) will comprise a software control strip (221) of the control button type, which may be selected individually. This selection may be performed for example by mouse click on the desired button, and this will cause the display, in a determined portion of the window, of a new screen window including information or software controls related to this button. For example, this strip (221) will comprise a button, for example called "parameterization" (223) providing parameterization of the dispensing of coins or notes or the list of authorized users as well as the operations which they are authorized to perform, the identification of the accounts which are assigned to them, or the identification codes of these users. By clicking on this button, it will be possible to parameterize the software.

Figure 12:
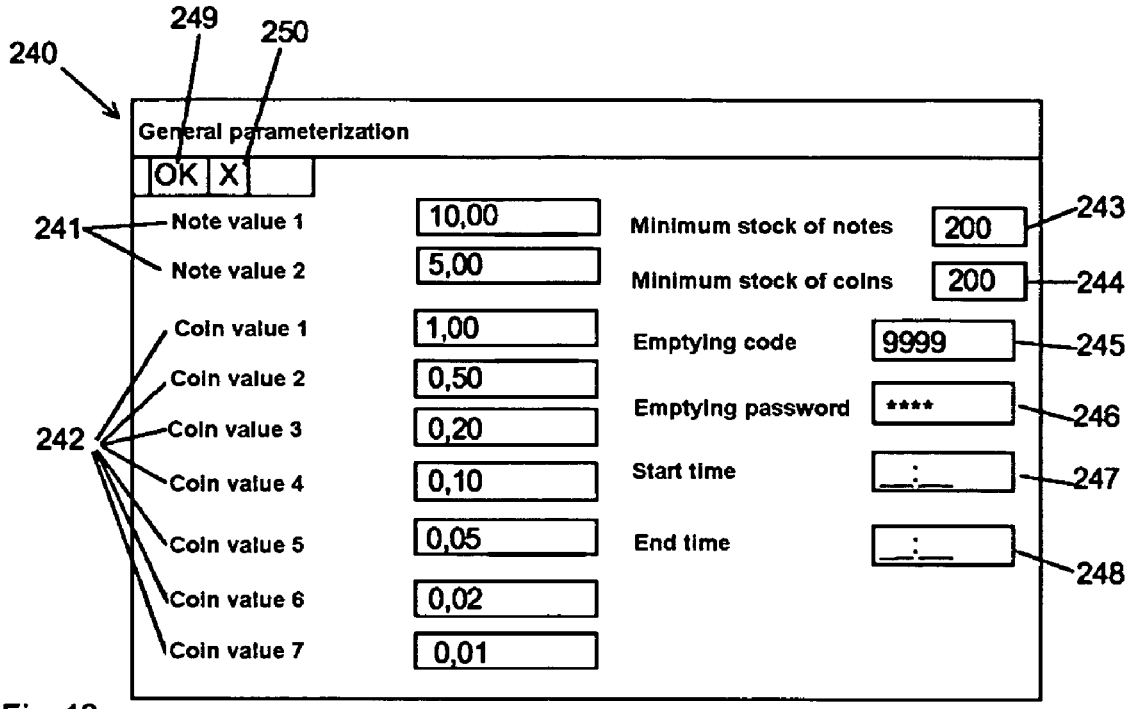
FIG. 12 illustrates a general parameterization screen of the automatic machine according to the invention.

First of all, a general parameterization of the automatic machine may be performed in a main parameterization screen window schematically illustrated in FIG. 12, for example during start-up or during a check or an inventory. This screen window (240) will comprise several fields for entering parameters to be stored in a database.

The automatic machine will include a plurality of storage hoppers (4) which are to dispense coins, seven hoppers for example. A single category of coins will be stored, i.e., a single type of coins, or several types of a same value in each hopper (4). A parameter to be entered (242) will therefore be the unit value of the coins introduced into each hopper. This input operation (242) will be performed on the general parameterization screen window (240). For example, in this window (240), we will select that coins having a value of 1.00 euro, will be introduced into a first hopper, 0.50 euro coins will be introduced into a second hopper, 0.20 euro coins in a third hopper, 0.10 euro coins in a fourth hopper, 0.05 euro coins in a fifth hopper, 0.02 euro coins in a sixth hopper, and 0.01 euro coins in the seventh hopper.

The automatic machine will include a plurality of cassettes and/or rolls for storing banknotes, for example three cassettes. A single category of notes i.e., a single type of notes or several types of a same value, will be stored in each of the two cassettes and/or rolls which are to distribute notes. A parameter to be entered (241) will therefore be the unit value of the notes introduced into each cassette/roll. This input operation (241) will be performed on the general parameterization screen window (240). For example, in this window (240), we will select that notes having a value of 10.00 euros will be introduced into a first cassette, 5.00 euro notes will be introduced into a second cassette, and no notes will be introduced into the third cassette.

Another parameter to be entered will be the minimum number of notes in stock in each cassette/roll, below which an alert message should be displayed. This message will for example specify that the automatic machine needs to be resupplied with notes.

Also, for all the coin hoppers, the minimum number of coins (244) in stock in each of the hoppers is entered. Below this value, an alert message will be displayed. This message will specify that the hopper for which the alert is activated, needs to be resupplied with coins.

Two other parameters to be entered will for example be a code (245) and a password (246), required for performing the emptying of the automatic machine. Entering this code by means of the external keyboard (32) or by means of the keyboard (101) on the automatic machine, is followed by a selection for withdrawing the till cash so as to cause the automatic machine to be completely emptied.

Finally, the last parameters to be entered are a start time (247) and an end time (248). The duration between these two times defines the time interval during which users are authorized to withdraw till cash amounts or till cash readjustments.

Validation of these parameters will, for example, be achieved by clicking on an icon (249) called "OK", for example. By selecting another icon (250) with the mouse, it will be possible to cancel this parameterization and to retain the prior parameterization.

Parameterization of the automatic machine in the management software comprises the placement and the storage, in a database (db2) stored in the storage means (M) of the computer system (3), of a list of various users who are authorized to use the automatic machine. In relationship with each of these users, parameters defining the operations which they are authorized to perform and the mode of performing these different operations are also stored in this database.

Figure 14:
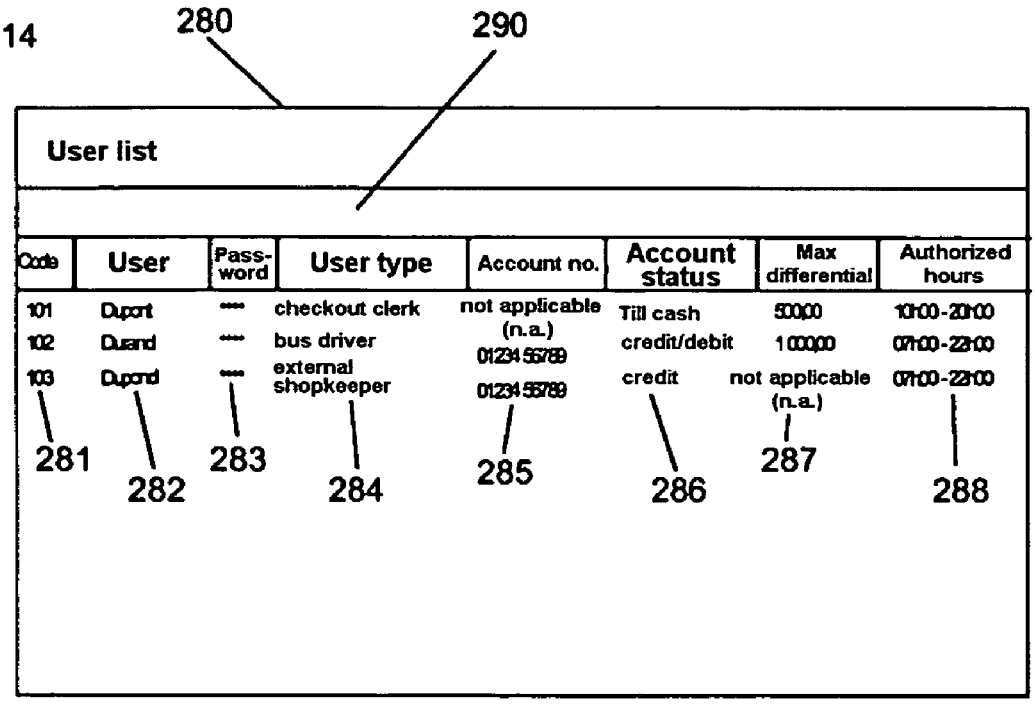
FIG. 14 illustrates a screen for parameterizing the list of users stored by the automatic machine.

This list may be viewed and changed in a screen window (280) illustrated in FIG. 14. In this window, a different identification code (281) is entered in order to identify each user. The name (282) of the user is associated with this identification code (281). Each user has a password (283) which will be stored in the database (db2). This password (283) corresponds to a code that the user will have to enter on the keyboard (101) of the dispenser (1) in order to perform one of the operations which are made available to him. This password (283) may be changed by the user from the keyboard (101) of the dispenser (1), in an operation accessible from the "User Options" selection of the operation selection window (210) described later on. It will be possible to suppress a user from the list by clicking on a specific icon of an icon strip (290).

For each user of this list, the database (db2) will store a piece of information (284) called "user type" which is displayed and may be changed in this window. This user type information (284) for example is in the form of a graphic interactive control of the "scroll list" type proposing different values suggested by the software for this information (284). The user type corresponds to a category for classifying authorized users. From a parameterization of the actual software, not detailed here, this user type information may be used by the software for suggesting predetermined values for certain parameters associated with the corresponding user, or for suggesting a selection of operations of the automatic machine or of sub-menus for parameterizing the automatic machine depending on this user type. As an example, a user type may represent a checkout clerk of a supermarket, who will exclusively use the automatic machine for withdrawing one or more till cash and/or readjustment amounts. This user type may also be a driver of a bus running on a line for which the terminus is close to the dispenser, and who will use the automatic machine for depositing his/her takings and re-filling his/her till cash with change. This user type may also be a shopkeeper external to the organization managing the automatic machine, who may exclusively use the automatic machine for performing operations with a neutral balance, such as counting or sorting change, or with a positive balance such as depositing takings at the end of the day.

For each user of this list, the database (db2) may store a piece of information (285) called "account number", which is displayed and may be changed in this window. This account number identifies a stored datum in the storage means (M) and representing a financial value owned by the user at the organization managing the automatic machine and the money which it contains. For each operation performed by the user at the automatic machine, the computer system stores as a debit or credit to this account, the value of the deposited or withdrawn change, or the difference of these values. As an example, the balance of an operation such as a deposit of takings with re-dispensing of till cash will be charged to the credit of the account assigned to the user, and it may be reimbursed or revalued to him/her in another form at the end of the period or by direct transfer from the organization managing the automatic machine to a bank account belonging to said user or to his/her employer.

For each user of this list, the database (db2) may store a piece of information (286) called "account status", which is displayed and may be changed in this window. This account status represents a type of operation, authorized or programmed for the account of this user, and it may for example comprise a limitation to only the operations which provide credit to the account, or identify this account as only representing a detailed account of the till cash or readjustments withdrawn by a checkout clerk.

For each user of this list, the database (db2) may store a piece of information (287) called "maximum differential" which is displayed and may be changed in this window. This maximum differential represents the maximum financial value corresponding to the total balance of the operations which this user may be authorized to perform during a given time period, for example one day. This information may be a useful security to limit risks, in particular in the case of fraud by an individual pretending to be an authorized user.

For each user of this list, the database (db2) may store a piece of information (288) called "authorized working hours" which is displayed and may be changed in this window. This information represents the hours during the day or during the week, when this user may use the automatic machine.

Figure 15:
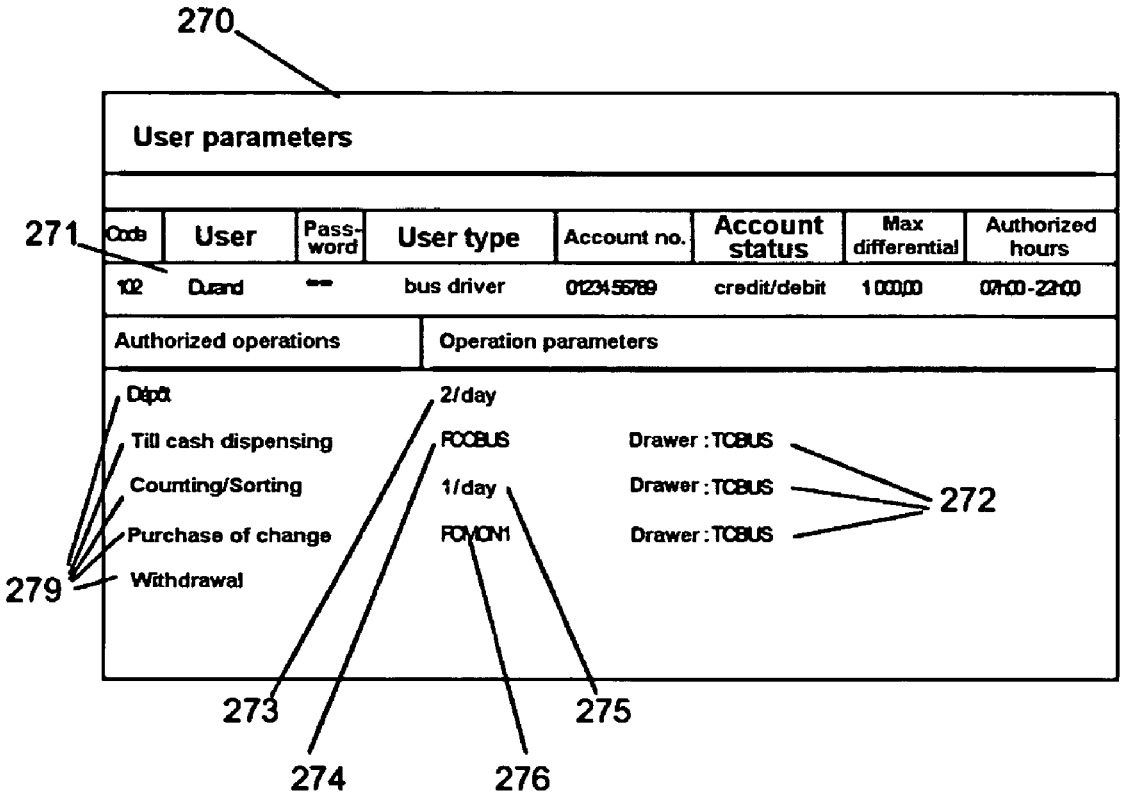
FIG. 15 illustrates a screen for parameterizing authorized operations for a user and stored by the automatic machine.

For each user belonging to this list of users, the database (db2) stores other parameters defining certain limits or characteristics of each type of operation which said user is authorized to perform. These extra parameters may be viewed and changed in a screen window (270) entitled "user parameters", illustrated in FIG. 15. This window may be obtained from the window (280) displaying the list of users, by a mouse click on the line of a user followed by a click on a specific icon displayed in the icon strip (290).

This window (270) of user parameters repeats the display (271) of the information line corresponding to the user within the user list, and also allows it to be changed. For this user, this window displays a list (279) of the operations which he/she is authorized to perform and a certain number of pieces of information, representing parameters (272), specific to these types of operations and to this user, for example operating limits or modes, and allows them to be changed.

For one or more of the operations including dispensing of coins, a parameter (272) facing each operation may indicate the code of a dispensing block (5), the geometry of which corresponds to the cash drawer used by this user.

For a deposit operation, a parameter (273) may indicate a maximum number of authorized deposits for a given period, for example per day.

For an operation dispensing till cash or till cash readjustment, a parameter (274) may indicate the code of a till cash composition to be used for this user. This composition may be entered and stored as described below.

For a counting operation or a counting operation with sorting, a parameter (275) may indicate the number of authorized counting operations for this user for a given time, for example per day.

For a change purchase operation, a parameter (276) may indicate the code of one or more compositions of coins and/or notes, corresponding to one or more determined amounts which should be transformed into change, from a deposit or by charging an account or by purchasing with a credit card or payment card. Although they may be used under different conditions, these compositions may be entered and stored as till cash, as described below.

Figure 13:
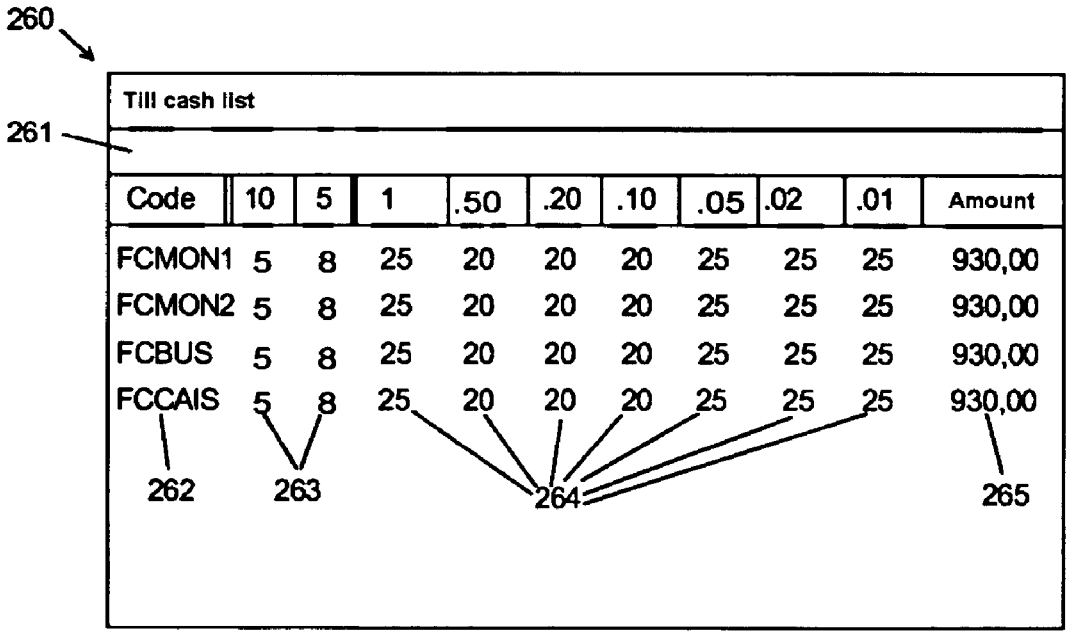
FIG. 13 illustrates a screen for parameterizing the types of till cash amounts stored by the automatic machine.

A parameterization of the types of available till cash will consist of entering the parameters related to the till cash list in order to store them in a database (db1) stored on the computer system (3). In a specific screen window (260), illustrated in FIG. 13, it will be possible to enter and store the parameterization of one or more types of till cash. Parameterization of a till cash amount consists of selecting the number of notes and the number of coins of each category, which one wishes to dispense for this till cash Several different users may have different till cash amounts, i.e., of different compositions. New till cash may be added to the list by clicking on a specific icon displayed within an icon strip (261). A first parameter to be entered is the code (262) allowing the till cash to be identified. Next, the number (263) of notes of each type which one wishes to assign to this till cash must be entered. Next, the number of coins (264) which one wishes to dispense in each category of coins should be assigned. The total amount (265) of the till cash will be calculated automatically. It will also be possible to suppress an existing till cash by selecting the line corresponding to the till cash which one wants to suppress and by clicking on a specific suppression icon from the icon strip (261).

According to an alternative of the invention, it will also be possible in a screen window (not shown) to parameterize the serial port of the computer system, to which is connected the automatic dispensing machine. It will be possible in this window to specify for each coin value, the number of the hopper which is assigned to this value. A same category of coins may be distributed over several hoppers. On the other hand, a hopper will not be able to comprise coins with different values.

Validation of all these parameters is for example achieved by clicking on an icon called "OK" for example.

In the operating portion of the software, the computer system (3) asks the user to identify himself/herself and suggests to him/her the different operations which he/she is authorized to perform, in particular depending on the parameters specific to this user, on the parameters specific to the automatic machine and on the amounts of change remaining inside the storage means of the automatic machine.

Identification of the user may be performed by known means and by different ways according to the embodiments; certain embodiments may use several identification modes. According to the users, or according to the user type, or according to the types of operations which they are authorized to perform, an identification mode may be requested by the automatic machine rather than another one, according to the security level provided by each of these modes. A selection of the identification modes may be stored as a parameter specific to the user or to a category of users.

These identification means may comprise the inputting of the user code (281) followed by the inputting of the password (283) stored for this user. These identification means may also comprise communication between the automatic machine and a portable object owned by the user and containing digital data, for example a magnetic badge or a transponder, or comprising a microprocessor and executing an identification algorithm, for example a specific or multi-application chip card.

Once the user is identified at the automatic machine, or before this identification, according to the embodiments, the software suggests that he/she select the operation(s) which he/she wishes to perform. The main operations are grouped together as displayed selections (230) on the screen (107) of the dispenser (1), as illustrated in FIG. 11*a*. Selection of these choices may be performed by entering on the keyboard (101), a number corresponding to the desired choice or by pressing on one of the external keys (106) located on the sides of the screen and opposite to which the different choices are displayed.

If the identification is performed before choosing the operation, the software may only suggest the available operations for this user at that time. If the identification is performed after choosing the operations, the software may suggest all the available operations at that moment, then request identification and may limit the choice or block the operation if the user has chosen an operation which he/she is not authorized to perform.

In order to perform a till cash or readjustment withdrawal operation, the user, for example a checkout clerk, should choose the operation "Till Cash Withdrawal" (216) or "Readjustment Withdrawal" (217) in the operation selection screen (210).

Figure 16:
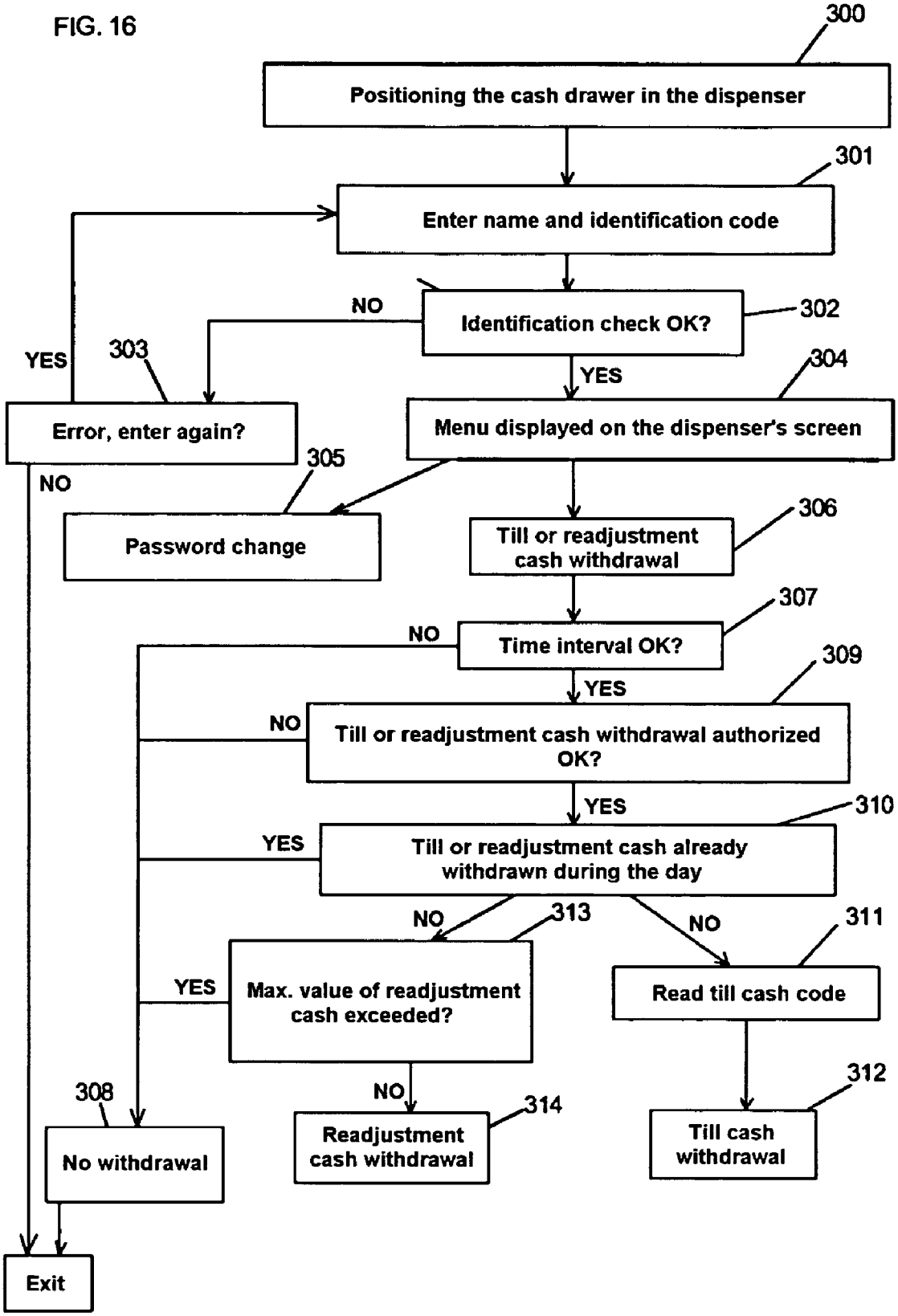
FIG. 16 illustrates a flowchart comprising the steps performed during withdrawal of the till cash by means of the automatic machine according to the invention.

The operation is then performed in the following way, a flowchart of which is illustrated in FIG. 16. The dispenser is closed and connected to the computer system (3) which controls it. Each hopper (4) is filled with coins of a certain coin category. The dispensing block (5*a*, 5*b*, 5*c*, 5*d*) installed in the dispenser (1) is the one suitable for the type of cash drawer (2*a*, 2*b*, 2*c*, 2*d*) to be fed with cash. In certain embodiments, the software or the user may control a change of dispensing block, if several different blocks are available in order to use the block suitable for the cash drawer used. If it is controlled by the computer system, this change in dispensing block is performed by selecting the block suitable for the identified user, by reading in the corresponding database (db1), a code (272) identifying this cash drawer or the dispensing block which is suitable for it.

The checkout clerk will begin in a first step (300) by positioning his/her cash drawer (2*a*, 2*b*, 2*c*, 2*d*) in the housing (103) provided in the dispenser (1), as illustrated in FIGS. 1*a*, 1*b* and 1*c*. The checkout clerk enters in a second step (301) by means of the keyboard (101), his/her identification code on the screen (102, 107) of the dispenser as well as his/her password. The computer system (3) identifies the checkout clerk by fetching and checking (302) the identification code and the associated password in the database (db2), in particular comprising the list of checkout clerks and the till cash which is associated with them. If the identification code of the checkout clerk, the password or both of them is wrong, an error (303) is generated and error message is displayed on the screen (102, 107) of the dispenser (1). This message may for example suggest restarting the entering procedure. On the other hand, if the identification code and the associated password are found in the database (db2), the system (3) controls the display (304) of a menu on the screen (102, 107) of the dispenser (1). For example this menu may comprise three options. A first option would for example be withdrawal of the till cash. A second option would for example be withdrawal of the readjustment cash and a third option would consist in changing (305) the password.

If the checkout clerk chooses the first or the second option (306), the computer system (3) consults the different databases (db1, db2). The computer system (3) should first see whether the checkout clerk is within the parameterized time interval (307) in order to be able to perform one of these withdrawals. If this is not case, no withdrawal (308) would be possible. If this is the case, the computer system (3) will have to consult the database (db2) of the list of checkout clerks and see whether the checkout clerk is authorized to withdraw his/her till cash or the readjustment cash (309). If the checkout clerk is not authorized, then no withdrawal (308) will be possible, the computer system (3) will then block the withdrawal process. If the checkout clerk is authorized, the system will check whether the checkout clerk has already withdrawn his or her number of till cash or readjustment cash amounts authorized per day (310). If this is the case, the computer system (3) will block the withdrawal process (308). If this is not the case, the computer system (3) has two possibilities according to whether the checkout clerk wishes to withdraw till cash or obtain readjustment cash. In the first case, the computer system (3) reads in the database the till cash code (311) associated with the identifier of the checkout clerk. The computer system (3) then searches for this till cash code in the database (db1). Once it has found this code in the database (db1), the system reads the value defining this till cash. These values are the number of notes for each category of notes to be dispensed for this till cash and the number of coins to be dispensed in each category of coins. The computer system then controls the dispenser for dispensing notes and coins (312). In the second case (313), i.e., if the checkout clerk wishes to withdraw readjustment cash, the computer system (3) will have to read in the database (db2) whether the checkout clerk has not already withdrawn the maximum value of authorized readjustment cash (313). If this is the case, no withdrawal (308) will be possible. On the other hand if it is not the case, the checkout clerk may enter the number of readjustments (314) which he/she wishes to withdraw, the latter should not exceed the maximum authorized value.

In order to perform an operation for depositing cash, for example the takings of a day or half-day, the user identifies himself/herself at the automatic machine and chooses the "deposit" operation. The software then controls actuation means, for example electromagnets or electrical cylinders, which open a panel masking the inlet of the device (14) for receiving notes and unlocks or opens the hatch (131) for receiving coins.

The user introduces the notes which he/she wishes to deposit into the note receiving device (14) and pours all the coins which he/she wishes to deposit into this receiving hatch (141). The introduced notes are then recognized, counted and forwarded into the storage cassettes of the dispenser. The number of recognized notes in each category is transmitted to the computer system (3) which calculates the amount which they represent, and stores this amount. The unrecognized notes may be given back to the user by the automatic machine, at the inlet of the receiving device or by the note dispensing means of the dispenser module (12). The notes recognized as belonging to a category to which a specific storage cassette is assigned, will then be forwarded towards this same cassette, where they will be redispensed during any operation including dispensing of notes. The recognized notes but of a category which does not have any specific cassette, will be stored in the first cassette from where they may be extracted during a subsequent emptying or reloading operation.

The added coins fall into the receptacle (142) which is moved by actuation means, for example by a driven chain or belt along a guiding slide. This mobile receptacle is moved towards the top of the dispenser where it discharges its contents into the receiving bin (134) of the coin receiving device (13). The number of recognized coins in each category is transmitted to the computer system (3) which calculates the amount and stores this amount. The coins recognized as belonging to a category to which a specific storage hopper (4) is assigned, will then be forwarded towards this same hopper, from where they will be redispensed during any operation including dispensing of coins. The recognized coins but of a category not having a specific hopper, will be stored in the eighth hopper (41) from where they may be extracted during a subsequent emptying of reloading operation.

After counting and valuation of the coins and notes deposited by the user, the computer system collates the thereby added amounts and updates in its storage means, the data representing the account assigned to the user, by adding the value of the deposited change thereto.

When the user chooses an operation for depositing takings or readjusting the till cash, the automatic machine successively performs a deposit operation, followed by dispensing of new till cash corresponding to the stored till cash code for this user. The value of the dispensed till cash is then subtracted from the deposited amount and this is the balance of this operation which is charged to the account of the user.

The user may also choose a counting operation, either followed or not by sorting per category. He/she will then deposit an amount of change which he/she wants to have counted, as coins and/or notes. The automatic machine will then perform counting and valuation, and then redispense the received coins and notes or others of the same number in the same categories. This operation may in particular be proposed as a counting service to users with which the organization managing the automatic machine has not a sufficiently direct or trustworthy relationship to assign an account to them, the added sums being then integrally redispensed. If the user chooses a counting and sorting operation, and if the automatic machine has a dispensing block compatible with a cash drawer of the user, redispensing of the deposited change will then be performed with this block. It is thus possible to propose a service to such users for sorting change from provided bulk amounts.

For the users which do not have an account, or for a partial readjustment, it is possible to perform a change purchase operation, i.e., dispensing of change as notes and/or coins of the available categories, in a determined composition, and in exchange for a cash deposit representing a same value. This change purchase may be performed in different ways.

A first way consists of depositing, as described earlier, an amount chosen by the user. The software then displays a screen (not shown) suggesting one or more coin or note categories which should form the main component of the dispensed change in exchange for deposit. For example, for a deposit of 100 euros, in 10 euros notes, the software may suggest dispensing 1 euro coins or 0.50 euro coins, or an equal distribution in value of 1 euro coins and 0.50 euro coins.

A second way for the user consists of choosing a composition type from a choice of compositions similar to typical till cash compositions, suggested by the software. The value of the selected composition will then be displayed and will be deposited by the user as described earlier or will be debited from the account of the user. These compositions may be entered and stored within the parameterization software, in the same way as the till cash amounts, and the code (276) of certain of these compositions may be stored as parameters associated with a user or a group of users.

In one alternative, it is also possible to perform purchase of change by using a credit card in a known way, for example by means of the chip card reader (108) used for identifying the user. For a user having an account stored by the computer system, such a purchase of change may also be debited from said account.

The automatic machine may also suggest a simple cash withdrawal, without any particular constraint on the composition of the change forming these cash amounts, in the same way as a conventional dispenser of the Automatic Teller Machine or Automatic Teller Dispenser type, by using the reader of an identification chip card for communicating with a credit card.

According to the invention, the main parameterization or management screen comprises a button, for example called "Daily" (222), which, when it is enabled, allows the operations which have been performed by the users of the automatic machine for a certain time, for example within the day, to be viewed According to the invention, the automatic machine will also comprise a printer communicating with the computing system (3) and printing sheets or tickets, at least a copy of which may be recovered by the user at the outside of the dispenser. These tickets will show a review of each operation, and may include the exact composition of the dispensed change or added change.

Also, the computer system (3) will store a complete review of each operation, in its storage means for the purposes of archiving, auditing, or financial clearing between operations performed at the automatic machine and the bank accounts of the users and of the organization managing the automatic machine.

In a particularly compact embodiment illustrated in FIG. 1*b*, the totality or a part of the computer system (3) is contained inside the dispenser (1), for example as a microcomputer (31) of a current design. In this alternative, the screen incorporated into the dispenser has sufficient graphic display features in order to be able to display all the management menus used by the computer system and described earlier. The screen used may for example be a screen (107) with an active matrix of the TFT type. These screens in particular include graphical windows using menus, icons, and graphic controls, and derived from an interactive graphic interface such as Windows (trade mark) of Microsoft, MacOS from Apple, or X-Windows from Sun (trade marks). Certain of these screens may display choices to be made by the user as graphical marks located on the edge of the screen, facing external buttons (106) present on the edge of the screen. These external buttons may be used by the user for performing a fast selection from the choices suggested by a display generated by the software, for example a type of operation or an amount to be withdrawn among several amounts.

In addition to external buttons (106) and to the keyboard (101) built into the dispenser (1), this alternative automatic machine according to the invention comprises an independent external keyboard (32) for entering all the data and information required for operating the microcomputer (31). This independent keyboard is of a current type for the microcomputer used, for example a standard 89 key computer keyboard or a standard 103 or 104 key computer keyboard. This independent keyboard is in communication with the microcomputer (31) contained inside the dispenser (1) with a wireless link of the radio or infrared type, or through a conventional connection with a wire which may be easily disconnected and reconnected without opening the dispenser (1). Thus, a responsible person may approach the dispenser (1) with the external keyboard (32) and perform any parameterization or polling operation of the computer system (3) without having to open the dispenser (1).

The computer (31) located inside the dispenser (1) is provided so as to be able to communicate with at least one computer system external to the dispenser (1), for example managing the accounting of a chain store equipped with this type of dispensers or belonging to an organization operating this automatic machine. This communication may be performed by a permanent or temporary connection, for example through a computer network or through a telephone link and a modem, or a radiotelephone link or any other digital link.

The dispenser (1) or the external keyboard (32) may also include a terminal capable of communicating with a portable computerized object comprising an electronic circuit, or a microprocessor, or storing computer information, for example a chip card reader (108). With this reader, it is then possible to perform authentication or encryption during the use of the automatic machine, directly on the dispenser (1) or during operations controlled by the external keyboard.

In one embodiment of the invention, recycling of the notes is achieved via an automatic recycling cash machine connected to the automatic machine, and positioned on the front of the dispenser (1). Reliable counting and fast valuation (for example 4 notes per second) of the notes are performed by the recycling cash machine. The first components (71) for depositing and withdrawing notes may consist of an input unit accepting bundles of notes with different sizes and designations. A detecting unit of the cash machine detects and triggers, if need be, rejection of folded or damaged notes (qualitative sorting) in order to limit the risk of error. Said detection unit is linked with means for checking the withdrawn or provided amounts. The notes deposited by the input unit are automatically sorted and placed in a plurality of cassettes (for example 8 cassettes), each with a large capacity (for example 350 notes). The thereby placed notes may then be "recycled" via an output unit of the recycling cash machine. This output unit is linked with said means for checking the withdrawn or provided amounts, in order to allow controlled re-dispensing of the notes. It is understood that the automatic recycling cash machine may form the note receiving device (14) of FIG. 1*d*, a safe ensuring storage of the notes in the cassettes.

One of the advantages of the invention is to allow an operator to perform complete management of the automatic machine while being placed on the opposite side to the front face (A), the user side, and to perform the emptying of the takings or the filling with coins and notes, for example. Another one of the advantages of the invention is to provide overall, fast and reliable management of the transactions.

It should be apparent to one skilled in the art that the present invention allows embodiments in many other specific forms without departing from the field of application of the invention as claimed.

While there have been described and illustrated specific embodiments of the invention, it will be clear that variations in the details of the embodiment specifically illustrated and described may be made without departing from the true spirit and scope of the invention as defined in the appended claims.

The invention claimed is:

1. In combination, an automatic machine for managing change or takings or till cash, as coins and notes, for allowing a user to perform one or more operations including depositing, sorting, and/or counting of coins and bank notes, the automatic machine comprising a coin storer, a note storer, a coin dispenser and a note dispenser, the dispensers being arranged for dispensing a determined composition of different types or values of at least one of coins and notes, a computer system coupled to said automatic machine and comprising a coin receiver and sorter and banknote receiver and sorter for providing receiving, recognition and sorting functions for coins and banknotes respectively, said automatic machine having:

a front face including a user machine interface including first components for enabling a user to deposit and withdraw notes, and second components for enabling a user to deposit and withdraw coins; and a rear face opposite to the front face, including a user machine interface for unlocking at least a first access from the rear face to the coin storer and/or at least a second access to the note storer; and said automatic machine comprising at least two interchangeable dispensing blocks, and an actuator controlled by the computer system or by the user for interchanging the dispensing blocks.

2. The combination according to claim 1, wherein the interface for unlocking can only be actuated after introduction of an identification code of an operator and checking of this code with a list of codes stored by the computer system.

3. The combination according to claim 1, wherein the computer system comprises a parameterization arrangement for parameterizing, via the interface of the front face, the dispensing of coins and dispensing of notes, the interface of the front face being arranged to take into account an identification of a user, said parameterization arrangement including:

a controller for controlling the coin dispenser and the note dispenser, the controller being arranged for (a) triggering ejecting units respectively positioned at an outlet of a coin storage location for initiating displacement of a determined number of coins towards the coin dispenser, and (b) controlling the note dispenser for triggering a note picker for picking notes so as to initiate the displacement of a determined number of notes towards the note dispenser;

said computer system also including:

a calculator arrangement for calculating a monetary amount corresponding to the coins or the notes, as received and recognized by the receiver and sorter, and a memory for storing data representing said amount and associating said data with data for identifying a user.

4. The combination according to claim 1, comprising a memory for storing information representing the coins and notes received by the receiver or dispensed by the dispenser during an operation, this information being stored in association with an identification of a user of the automatic machine for this operation.

5. The combination according to claim 1, wherein the dispenser is arranged to be controlled by a controller driven by the computer system to dispense, for each type or value of coin or note, a determined amount stored or calculated by the computer system depending on a requested operation type, an identification of the user of the automatic machine, or an amount or value of coins or notes received by the receiver or sorter or a combination of the receiver and sorter.

6. The combination according to claim 1, wherein the coin storer comprises a plurality of hoppers having ejectors for ejecting coins one by one and a counter for counting the ejected coins, and each hopper being arranged to be fed with the same type or with the same value of coins, and a structure for automatically bringing the coins from the coin receiver and sorter to the coin storer.

7. The combination according to claim 1, further including a plurality of chutes for forwarding the coin ejected from the hoppers to outlets of the chutes, the outlets of the chutes being positioned according to a specific geometry of the coins for causing the dispensed coins to be distributed into different compartments of a container or a cash drawer with a determined shape, at least one of the compartments being arranged for receiving coins of same type or value.

8. The combination according to claim 7, wherein at least two of the chutes abut in a geometry determining dispensing block for distributing coins suitable for a container or cash drawer type, the dispensing block being positioned at the outlet of the hoppers by positioners for enabling the use of several different interchangeable blocks suitable for different types of containers.

9. The combination according to claim 1, wherein the banknote storer comprises at least two storage cassettes including a banknote dispenser and counter, each of the cassettes being arranged to contain notes of the same type or same value and at least one cassette for receiving notes of different types, at least one of these cassettes for receiving notes of different types being able to automatically receive notes from the note receiver and note sorter.

10. The combination according to claim 1, comprising a link for communicating with a portable computerized object including a memory for storing at least one identification datum of a user of the automatic machine.

11. The combination according to claim 3, wherein the memory is enclosed in a closed device, a dispenser arranged to make the stored coins and notes inaccessible to users, this dispenser comprising a coin or note transfer structure for external transfer of coins or notes, the transfer structure comprising at least one container for (a) feeding the memory of the dispenser or (b) receiving coins or notes from inside the dispenser, the transfer structure being able to feed the dispenser or to be fed by the dispenser, and being able to be transported out of the dispenser by a transfer operator, without said operator having access to the coins or notes contained in the dispenser or in the transfer structure.

12. In combination, an automatic machine for managing change or takings or till cash, as coins and notes, for allowing a user to perform one or more operations including depositing, sorting, and/or counting of coins and bank notes, the automatic machine comprising a coin storer, a note storer, a coin dispenser and a note dispenser, the dispensers being arranged for dispensing a determined composition of different types or values of at least one of coins and notes, a computer system coupled to said automatic machine and comprising a coin receiver and sorter and banknote receiver and sorter for providing receiving, recognition and sorting functions for coins and banknotes respectively, said automatic machine having:

a front face including a user machine interface including first components for enabling a user to deposit and withdraw notes, and second components for enabling a user to deposit and withdraw coins; and a rear face opposite to the front face, including a user machine interface for unlocking at least a first access from the rear face to the coin storer and/or at least a second access to the note storer, wherein the computer system comprises a parameterization arrangement for parameterizing, via the interface of the front face, the dispensing of coins and dispensing of notes, the interface of the front face being arranged to take into account an identification of a user, said parameterization arrangement including:

a controller for controlling the coin dispenser and the note dispenser, the controller being arranged for (a) triggering ejecting units respectively positioned at an outlet of a coin storage location for initiating displacement of a determined number of coins towards the coin dispenser, and (b) controlling the note dispenser for triggering a note picker for picking notes so as to initiate the displacement of a determined number of notes towards the note dispenser;

said computer system also including:

a calculator arrangement for calculating a monetary amount corresponding to the coins or the notes, as received and recognized by the receiver and sorter, and a memory for storing data representing said amount and associating said data with data for identifying a user, wherein the memory is enclosed in a closed device, a dispenser arranged to make the stored coins and notes inaccessible to users, this dispenser comprising a coin or note transfer structure for external transfer of coins or notes, the transfer structure comprising at least one container for (a) feeding the memory of the dispenser or (b) receiving coins or notes from inside the dispenser, the transfer structure being able to feed the dispenser or to be fed by the dispenser, and being able to be transported out of the dispenser by a transfer operator, without said operator having access to the coins or notes contained in the dispenser or in the transfer structure, wherein the transfer structure for receiving coins is located in a top portion of the dispenser, the combination further including a path for enabling the coins to pass, under the effect of gravity, from the receiver and sorter towards the coin storer, the dispenser comprising a receptacle located at a determined height lower than that of the receiver and sorter, this receptacle being able to receive coins to be sorted, deposited by the user at a height substantially lower than that of the receiver and sorter, and then to be displaced by an elevator to said receiver for pouring the coins in the receptacle into the receiver.

13. The combination according to claim 12, wherein the computer system comprises an internal computer located inside the dispenser for storing parameters for enabling the automatic machine to operate autonomously for a plurality of operations.

14. The combination according to claim 13, wherein the internal computer is able to communicate with a keyboard outside the dispenser, the keyboard forming an input interface for this computer, via a temporary electrical connection or wireless communication link, without requiring the opening of the dispenser.

15. The combination according to claim 13, wherein the computer is able to communicate with at least one computer system outside the automatic machine, via a computer network or a permanent or temporary computer link, this communication allowing remote reporting or parameterization of the available operations or of the databases used during these operations.

16. The combination according to claim 1, wherein the computer system comprises a computer for using an operating system running under an interactive graphic interface in order to implement management or parameterization of the available operations or of the databases used during these operations.

17. The combination according to claim 12, wherein the elevator comprises a coin elevator unit interposed between a first unit for forwarding coins, connected to a front port of the automatic machine on the one hand, and a unit for forwarding coins, connected to a rear port or the automatic machine on the other hand.

18. The combination according to claim 17, wherein said first access from the rear comprises an access hatch for communicating with a second unit for forwarding coins.

19. The combination according to claim 17, wherein said second access from the rear comprises a door for accessing a safe for storing notes, said safe including translationally mobile note cassettes on slides to allow removal of said cassettes towards the rear.

20. The combination according to claim 19, wherein the interface of the rear face is arranged to associate at least one code with each of the cassettes, the interface having a reader for reading said code for identifying each cassette and the amount of the contents corresponding to the identified cassette.

21. The combination according to claim 1, wherein the interface on the rear face includes a display screen and an input device for notifying an operation for withdrawing or providing coins on the one hand and an operation for withdrawing or providing notes on the other hand, the screen and the input interface being connected to the computer system which is arranged to use said memory for storing data representing an amount of the notified operations and the identity of the operator.

22. The combination according to claim 1, comprising a checker for checking withdrawn or provided amounts by counting coins and notes, said checker being connected to the interface of the front face and to the interface of the rear face to perform a check of a first total amount corresponding to the coins present in the automatic machine and a second total amount corresponding to the notes present in the automatic machine.

* * * * *